US011001065B2

(12) United States Patent
Takahashi et al.

(10) Patent No.: US 11,001,065 B2
(45) Date of Patent: May 11, 2021

(54) ROLL DEVICE, ROLL APPARATUS, HEAD MAINTENANCE DEVICE, AND LIQUID DISCHARGE APPARATUS

(71) Applicants: Kenta Takahashi, Kanagawa (JP); Yukihiro Asano, Kanagawa (JP); Daisuke Hasebe, Kanagawa (JP); Tatsuroh Watanabe, Kanagawa (JP)

(72) Inventors: Kenta Takahashi, Kanagawa (JP); Yukihiro Asano, Kanagawa (JP); Daisuke Hasebe, Kanagawa (JP); Tatsuroh Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/550,005

(22) Filed: Aug. 23, 2019

(65) Prior Publication Data

US 2020/0079091 A1 Mar. 12, 2020

(30) Foreign Application Priority Data

Sep. 7, 2018 (JP) ..... JP2018-167631

(51) Int. Cl.

| | |
|---|---|
| ***B41J 35/04*** | (2006.01) |
| ***B41J 2/165*** | (2006.01) |
| ***B05B 15/50*** | (2018.01) |
| ***B41J 35/00*** | (2006.01) |

(52) U.S. Cl.

CPC ..... *B41J 2/16544* (2013.01); *B05B 15/50* (2018.02); *B41J 35/00* (2013.01); *B41J 35/04* (2013.01); *B41J 2/16517* (2013.01); *B41J 2/16535* (2013.01); *B41J 2002/1655* (2013.01)

(58) Field of Classification Search

CPC ..... B41J 2/16544; B41J 2002/1655; B41J 2/16517; B41J 2/16535; B41J 35/00; B41J 35/04; B05B 15/50

See application file for complete search history.

(56) References Cited

U.S. PATENT DOCUMENTS

| | | | | |
|---|---|---|---|---|
| 3,797,777 | A * | 3/1974 | Hosono | G11B 15/674 242/346 |
| 5,135,319 | A * | 8/1992 | Kobayashi | B41J 33/52 400/208 |
| 2010/0182370 | A1 | 7/2010 | Nemoto et al. | |
| 2011/0012978 | A1 | 1/2011 | Kawashima | |
| 2011/0221821 | A1 | 9/2011 | Asano et al. | |
| 2016/0325550 | A1 | 11/2016 | Masaoka et al. | |

(Continued)

FOREIGN PATENT DOCUMENTS

| | | | | |
|---|---|---|---|---|
| JP | 2010-264675 | | 11/2010 | |
| JP | 2011025621 | A * | 2/2011 | B41J 2/165 |

(Continued)

OTHER PUBLICATIONS

European Search Report; Application EP19193026; dated Mar. 18, 2020.

*Primary Examiner* — Yaovi M Ameh
(74) *Attorney, Agent, or Firm* — Duft & Bornsen, PC

(57) ABSTRACT

A roll device includes a feeding roll in which a web is wound, a winding roll configured to wind the web fed from the feeding roll, and a partition disposed between an outermost winding portion of the web fed from the feeding roll and an inner winding portion of the web overlapped with the outermost winding portion.

7 Claims, 20 Drawing Sheets

(56) References Cited

U.S. PATENT DOCUMENTS

| | | | |
|---|---|---|---|
| 2018/0126737 | A1 | 5/2018 | Asano |
| 2019/0184709 | A1 | 6/2019 | Hasebe et al. |

FOREIGN PATENT DOCUMENTS

| | | | | | |
|---|---|---|---|---|---|
| JP | 2011025621 | A | | 2/2011 | |
| JP | 2011126129 | A | | 6/2011 | |
| JP | 2011025621 | A | * | 10/2011 | ..... B41J 2/165 |
| JP | 2013-103377 | | | 5/2013 | |
| JP | 2013-173244 | | | 9/2013 | |
| JP | 2019-104132 | | | 6/2019 | |
| WO | 2014065170 | A1 | | 5/2014 | |

* cited by examiner

ROLL DEVICE, ROLL APPARATUS, HEAD MAINTENANCE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-167631, filed on Sep. 7, 2018, in the Japan Patent Office, the entire disclosure of which is hereby incorporated by reference herein.

BACKGROUND

Technical Field

Aspects of the present disclosure relate to a roll device, a roll apparatus, a wiping device, a head maintenance device, and a liquid discharge device.

Related Art

A liquid discharge apparatus includes a liquid discharge head to discharge a liquid from nozzles and a maintenance mechanism (maintenance device) that includes a cap to cap a nozzle surface, in which the nozzles are formed, of the liquid discharge head, a wiper to wipe and clean the nozzle surface to maintain and recover discharge function of the nozzles in the nozzle surface.

SUMMARY

In an aspect of this disclosure, a roll device includes a feeding roll in which a web is wound, a winding roll to wind the web fed from the feeding roll, and a partition disposed between an outermost winding portion of the web fed from the feeding roll and an inner winding portion of the web overlapped with the outermost winding portion.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
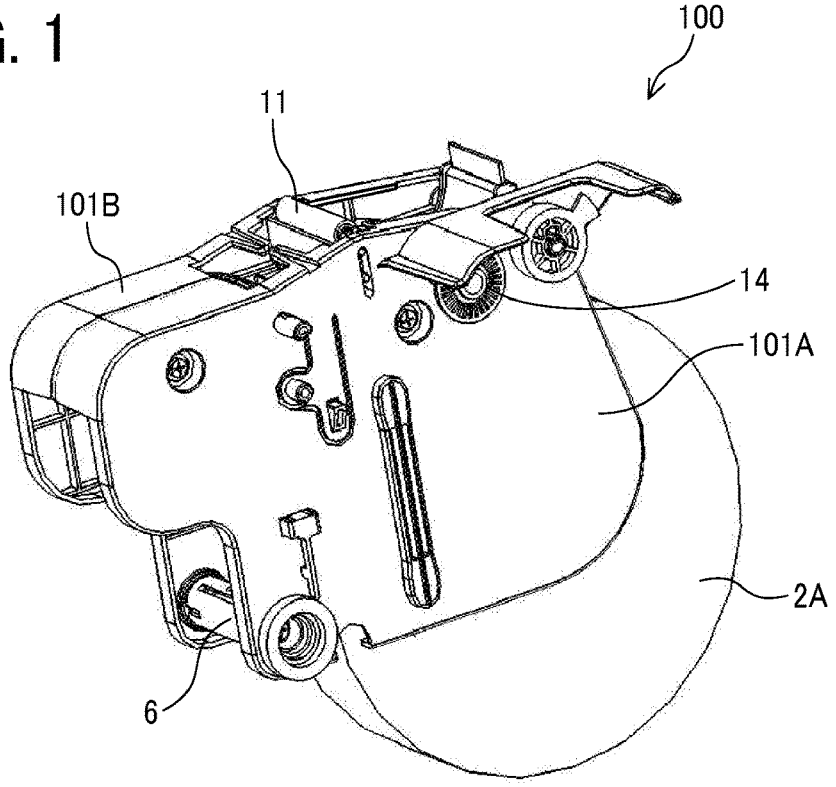
FIG. 1 is an external perspective view of a wiping cartridge as a roll unit according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, exemplary embodiments of the present disclosure are described below.

A first embodiment of the present disclosure is described with reference to FIGS. 1 to 6.

FIG. 1 is an external schematic perspective view of a wiping cartridge as a roll unit according to a first embodiment of the present disclosure.

Figure 2:
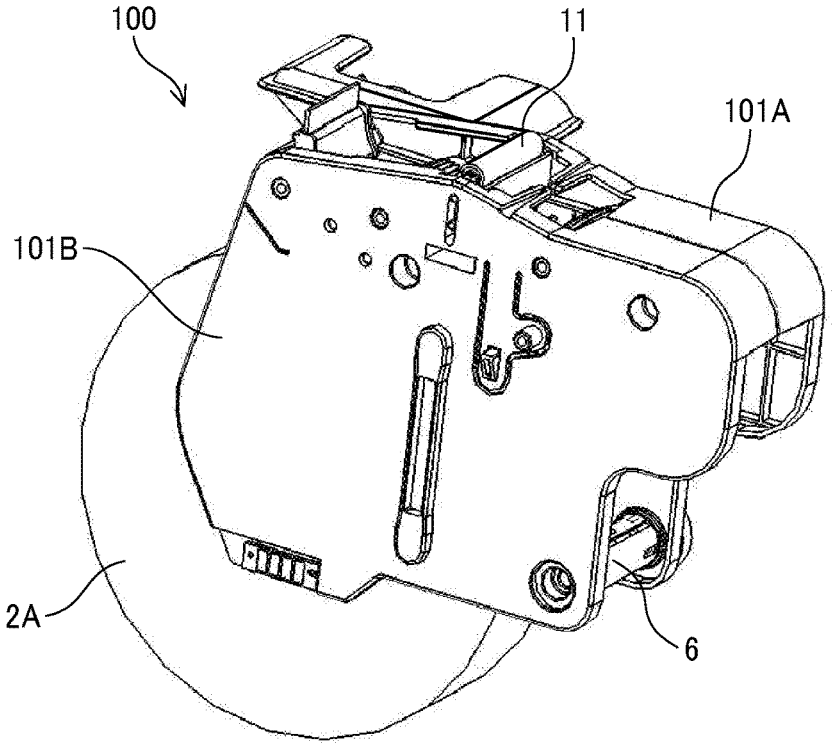
FIG. 2 is an external perspective view of the wiping cartridge as viewed from the opposite side to FIG. 1.

FIG. 2 is an external schematic perspective view of the wiping cartridge as viewed from the opposite side to FIG. 1.

Figure 3:
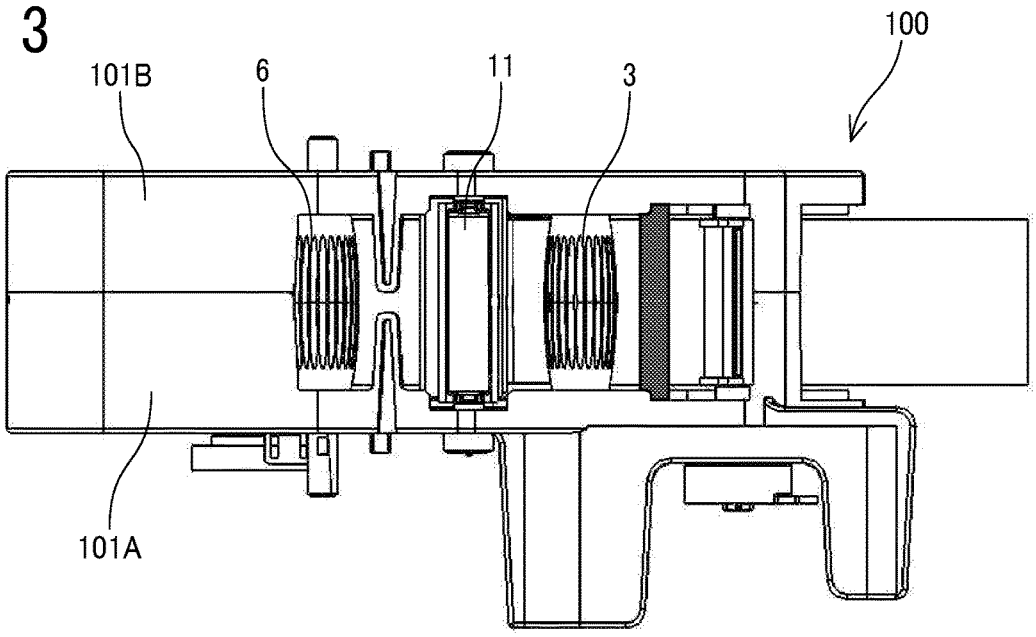
FIG. 3 is a plan view of the wiping cartridge.

FIG. 3 is a schematic plan view of the wiping cartridge.

Figure 4:
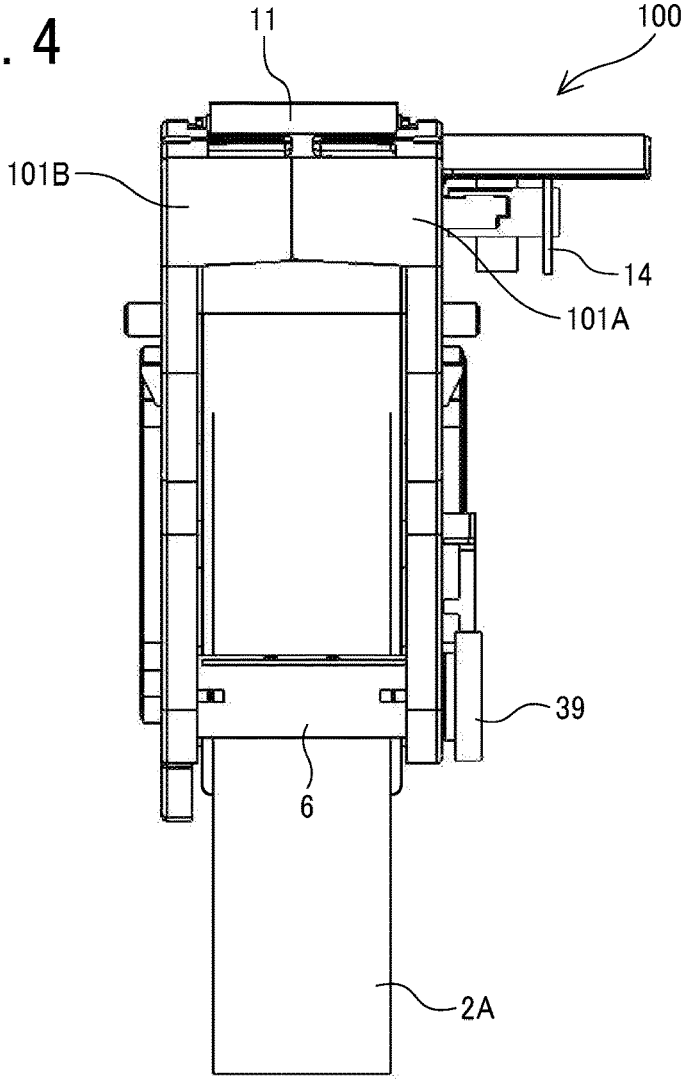
FIG. 4 is a front view of the wiping cartridge.

FIG. 4 is a schematic front view of the wiping cartridge.

Figure 5:
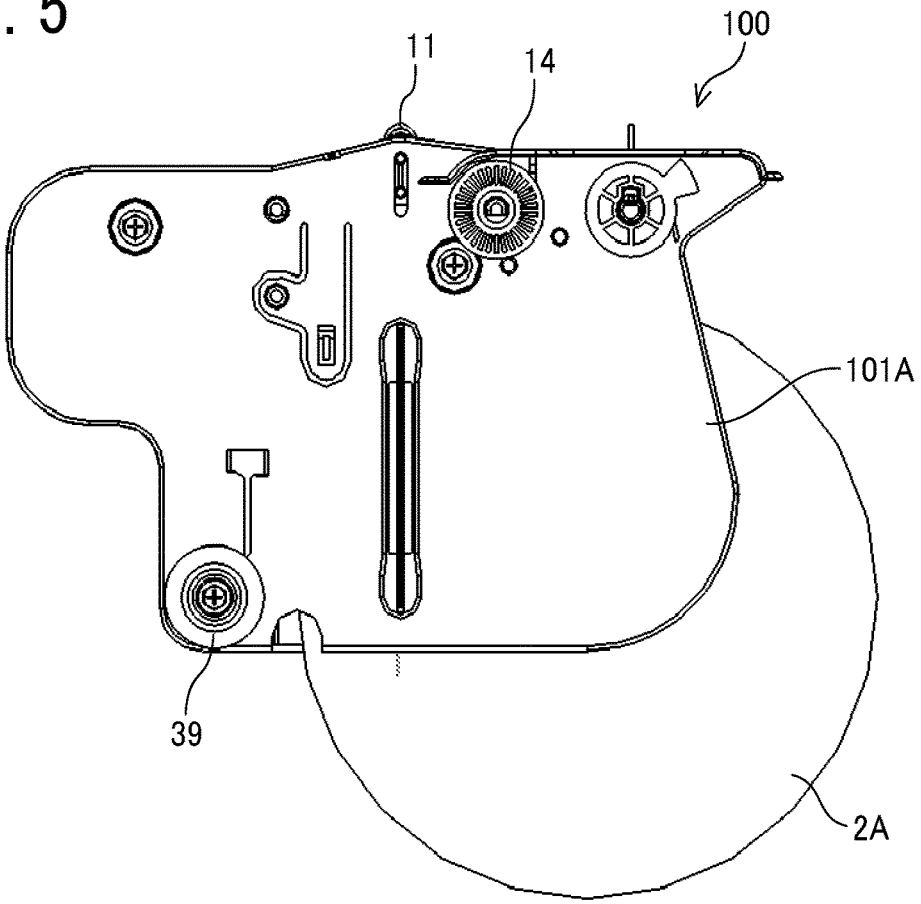
FIG. 5 is a side view of the wiping cartridge.

FIG. 5 is a schematic side view of the wiping cartridge.

Figure 6:
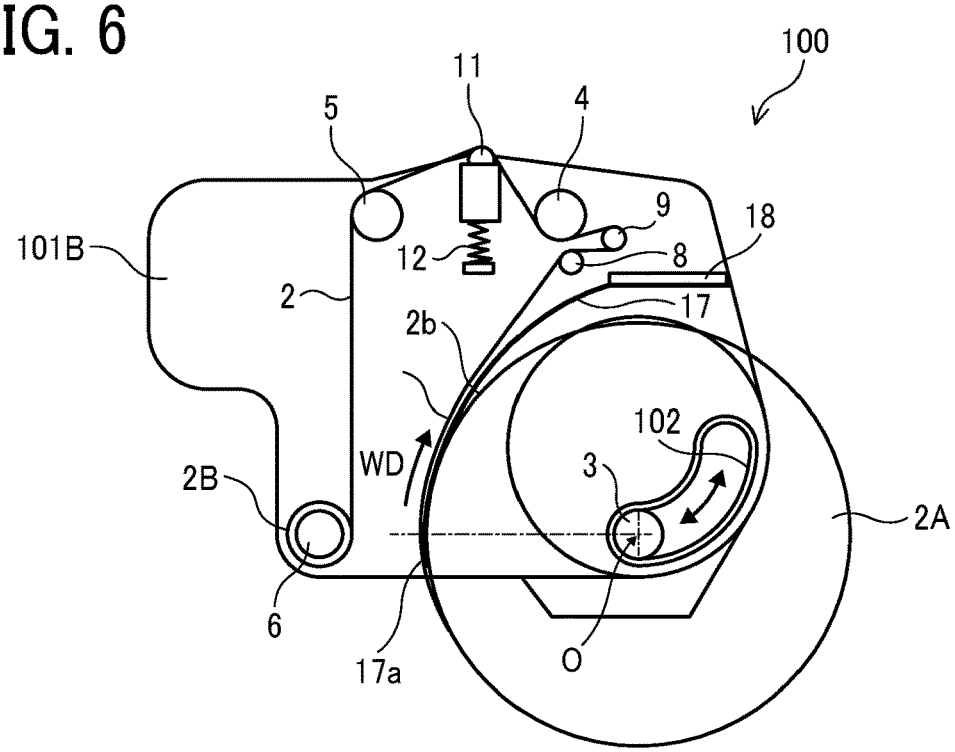
FIG. 6 is an internal side view of the wiping cartridge.

FIG. 6 is a schematic internal side view of the wiping cartridge.

A wiping cartridge 100 includes a web 2, a feeding roller 3, and a winding roller 6. The feeding roller 3 is a core member of a feeding roll 2A on which the web 2 as a wiping member (sheet member) is wound in a roll shape. The winding roller 6 is a core member of the winding roll 2B on which the web 2 delivered from the feeding roll 2A is wound. The web 2 is in wound in both of the feeding roll 2A and the winding roll 2B.

In an initial state, the web 2 is not wound around the winding roller 6. However, for clear explanation, the winding roll 2B is formed on the winding roller 6 as illustrated in FIG. 6.

The web 2 is preferably made of a sheet-shaped member (material) having absorbency and liquid resistance to at least the liquid used, and preferably does not cause a shaggy surface or dust. Thus, the web 2 has a shape of a sheet. For example, the web 2 may be made of non-woven fabric, cloth, film, paper and the like.

The web 2 is drawn from the feeding roll 2A of the feeding roller 3, passes through guide rollers 8 and 9 and conveyance rollers 4 and 5, and is wound up by the winding roller 6 as the winding roll 2B. Here, a feeding side of the feeding roll 2A and the winding side of the winding roll 2B faces each other.

The feeding roller 3, the winding roller 6, the guide rollers 8 and 9, and the conveyance rollers 4 and 5 are rotatably held by the two dividable cartridge cases 101 (101A and 101B) of the wiping cartridge 100.

Then, the feeding roller 3 that is one of an axial core of the feeding roller 3 and the winding roller 6 is movably held in a guide groove 102 formed in the cartridge case 101 so that the feeding roller 3 is movable relative to the winding roller 6 that is another axial core of the feeding roller 3 and the winding roller 6.

Here, the guide groove 102 is formed in a curved shape along which the feeding roller 3 as one of the axial core can move obliquely upward while separating from the winding roller 6 as another axial core.

Thus, the feeding roller 3 is initially moved to a lower end position of the guide groove 102 by a weight of the feeding roll 2A, and a distance between the feeding roller 3 and the winding roller 6 becomes the closest.

Further, a pressing member 11 to press the web 2 against the object to be wiped is disposed between the two conveyance rollers 4 and 5. When the pressing member 11 brings the web 2 into contact with the object to be wiped, the spring 12 presses the web 2 against the object to be wiped with a predetermined pressing force.

A code wheel 14 is attached to the conveyance roller 4.

As illustrated in FIG. 6, the partition 17 is disposed (sandwiched) between an outermost circumferential winding portion 2*a* of the web 2 fed from the feeding roll 2A and an inner winding portion 2*b* overlapped with the outermost circumferential winding portion 2*a*. The inner winding portion 2*b* is disposed one-layer inner side of the outermost circumferential winding portion 2*a*. Hereinafter, "the outermost circumferential winding portion 2*a*" is simply referred to as "the outermost winding portion 2*a*", and "the inner winding portion 2*b* overlapped with the outermost circumferential winding portion 2*a*" is simply referred to as "the inner winding portion 2*b*".

A leading end 17*a* of the partition 17 is inserted between the outermost winding portion 2*a* and the inner winding portion 2*b* of the web 2 in a direction that is counter to the winding direction as indicated by arrow "WD" in FIG. 6. A rear end of the partition 17 is held by a partition supporter 18 formed in the cartridge case 101.

With the partition 17 in FIG. 6, the outermost winding portion 2*a* and inner winding portion 2*b* overlapped by the outermost winding portion 2*a* does not directly contact. Thus, the partition 17 can prevent the feeding roll 2A to be rotated by a friction force generated between the outermost winding portion 2*a* and the inner winding portion 2*b* when the outermost winding portion 2*a* is fed.

Therefore, even when slack occurs in the web 2 of the feeding roll 2A, the feeding roll 2A rotates after only the outermost winding portion 2*a* is fed to eliminate the slack. Thus, the wiping cartridge 100 can prevent an increase of the slack of the web 2.

Here, the partition 17 is preferably formed of a flexible member such as a mylar sheet. Thus, the partition 17 can be displaced according to a change of a winding diameter of the feeding roll 2A.

Further, the partition 17 preferably has a coefficient of static friction with the web 2 smaller than the coefficient of static friction between the webs 2. Such a partition 17 may be made the mylar sheet as described above.

Figure 7:
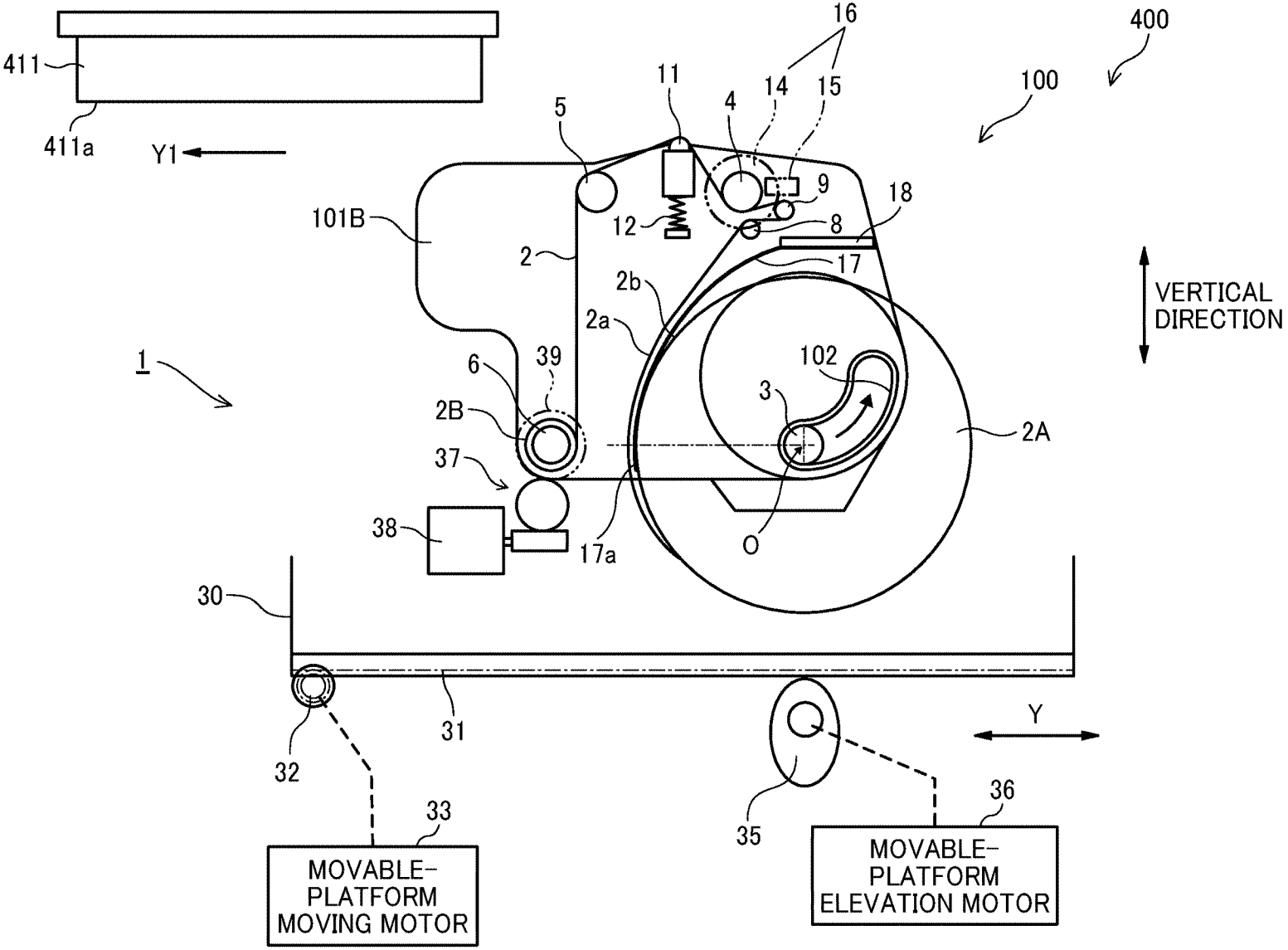
FIG. 7 is a side view of a wiping device as a roll device according to the present disclosure.

Further, the web 2 is fed upward from the feeding roll 2A, and a leading end 17*a* of the partition 17 is disposed lower than an axis "O" of the feeding roll 2A in a vertical direction indicated by arrow in FIG. 7.

Thus, the outermost winding portion 2*a* does not directly contact the inner winding portion 2*b* by the partition when the web 2 is slack. Thus, a slack portion of the web 2 can be fed upward without rotating the feeding roll 2A until the slack disappears during feeding the outermost winding portion 2*a*.

Next, the wiping device as a roll device according to the present disclosure is described with reference to FIG. 7. FIG. 7 is a side view of a liquid discharge apparatus 400 including the wiping device 1 that includes the wiping cartridge 100.

The wiping device 1 wipes a nozzle surface 411*a* of a liquid discharge head 411 of a liquid discharge apparatus as a wiping target. Hereinafter, the liquid discharge head 411 is also referred to as the "head 411".

The wiping cartridge 100 as a roll unit (here, the wiping device) is detachably mounted on a movable platform 30.

The movable platform 30 includes a transmission mechanism 37 and a winding motor 38. The transmission mechanism 37 engages with a gear 39 provided on the winding roller 6 when the wiping cartridge 100 is mounted to the movable platform 30. The winding motor 38 rotates the winding roller 6 via the transmission mechanism 37.

Further, the movable platform 30 includes an encoder sensor 15 using a transmission-type photo sensor to detect a pattern formed on a code wheel 14 of the wiping cartridge 100. The code wheel 14 and the encoder sensor 15 constitute an encoder 16 to detect a moving distance (feed amount) of the web 2.

The movable platform 30 is reciprocally movable in a direction indicated by arrow "Y" in FIG. 7. "Y" direction is along a nozzle arrangement direction of the head 411. The movable platform 30 enable the movement of the movable platform 30 in the wiping direction Y1 as indicated by arrow "Y1" in FIG. 7. The movable platform 30 may include a rack 31, a pinion 32, and a movable platform moving motor 33 to rotate the pinion 32. The movable platform 30 may include a timing belt and a pulley Further, the movable platform 30 is vertically movable in a direction in which the web 2 advances to and retracts from the nozzle surface 411*a*. The movable platform 30 includes an elevation mechanism that includes a cam 35 and a movable-platform elevation motor 36 to rotate the cam 35 or a rack and pinion to vertically move the movable platform 30.

Next, the wiping operation of the wiping device 1 is described below.

When the wiping device 1 wipes the nozzle surface 411*a* of the head 411, the movable platform 30 ascends, and the web 2 is pressed against at one end of the nozzle surface 411*a* of the head 411 by the pressing member 11 at a predetermined pressing force. The one end of the nozzle surface 411*a* of the head 411 is a wiping start position of the wiping operation of the wiping device 1.

Then, the movable platform 30 moves in the wiping direction (Y1 direction) to wipe or absorb to remove the liquid (waste liquid) remained on the nozzle surface 411*a* by the web 2.

The winding roller 6 is rotated to wind the web 2 on the winding roll 2B after the above-described wiping operation and before a next wiping operation. Then, unused portion of the web 2 contacts the nozzle surface 411*a* when the wiping device 1 wipes the nozzle surface 411*a* on the next wiping operation. Further, the wiping operation may also be performed while rotating the winding roller 6 and winding the web 2 on the winding roll 2B. That is, wiping operation may be performed while feeding the web 2 from the feeding roll 2A to the winding roll 2B.

Figure 8B:
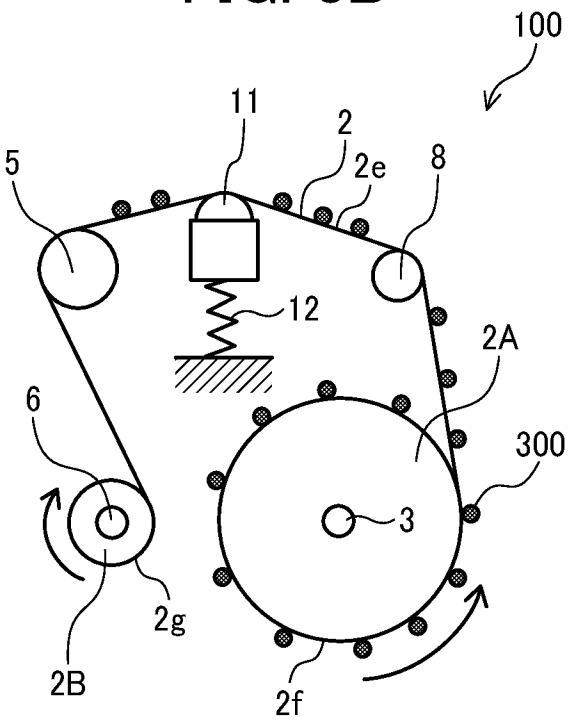
FIGS. 8A and 8B are schematic side views of the wiping cartridge illustrating a relation between a wiping surface of the web and a surface of the feeding roll.
Figure 8A:
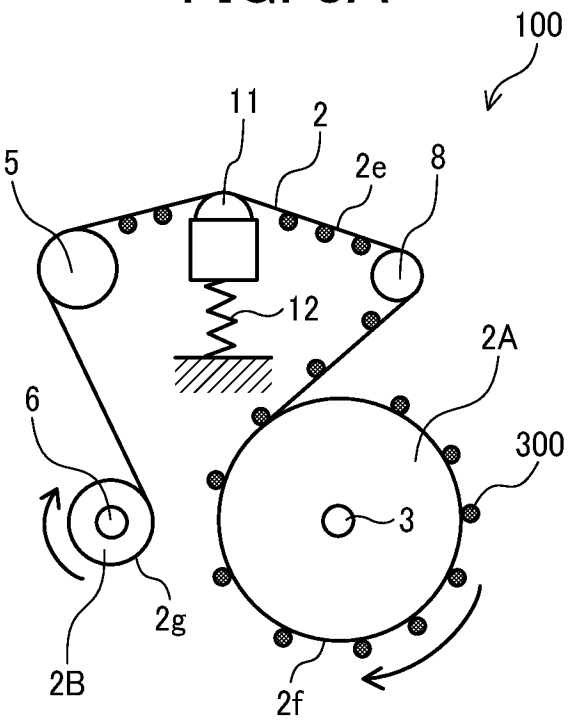
Figure 9B:
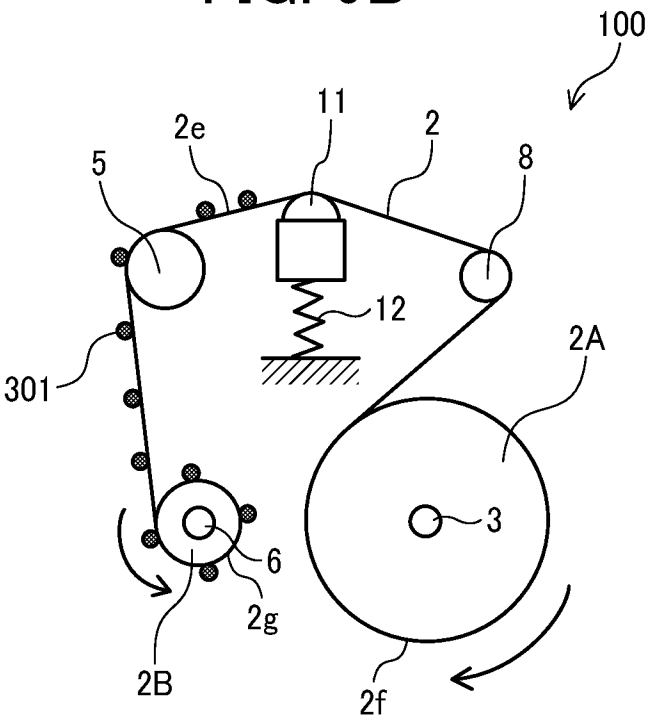
FIGS. 9A and 9B are schematic side views of the wiping cartridge illustrating a relation between a wiping surface of the web and a surface of the winding roll.
Figure 9A:
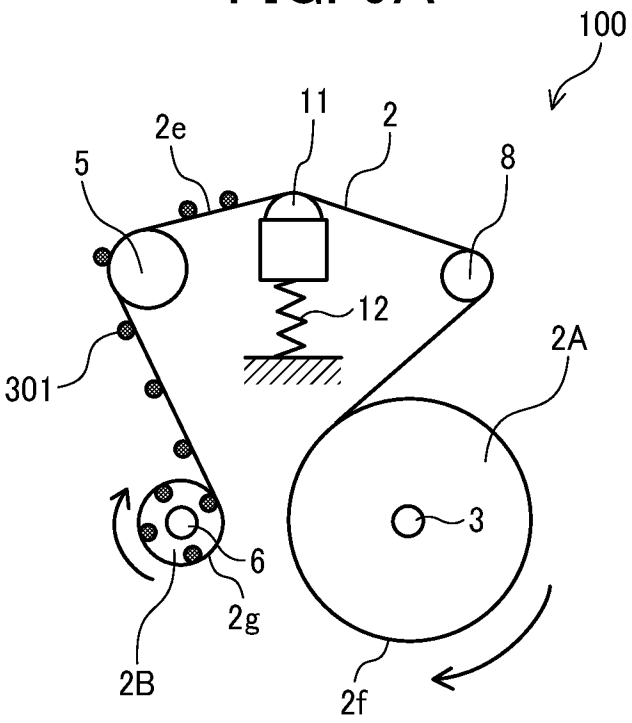

FIGS. 8A and 8B, and FIG. 9 illustrate a winding of the web 2 in the wiping cartridge 100 is described below. FIGS. 8A and 8B are schematic side views of the wiping cartridge 100 illustrating a relation between a wiping surface 2*e* of the web 2 and a surface 2*f* of the feeding roll 2A. FIGS. 9A and 9B are schematic side views of the wiping cartridge 100 illustrating a relation between a wiping surface 2*e* of the web 2 and a surface 2*g* of the winding roll 2B. FIGS. 8A and 8B and 9A and 9B illustrate only the guide roller 8 as a first member to contact the web 2 fed out from the feeding roll 2A.

As illustrated in FIG. 8A, the web 2 is rolled so that a wiping surface 2*e* of the web 2 is different from a surface 2*f* of the feeding roll 2A. In other words, the wiping surface 2*e* is an opposite surface of the surface 2*f* of the feeding roll 2A.

Thus, the surface 2*f* of the web 2 on which the adhered substance 300 adheres does not become the wiping surface 2*e* when dirt such as paper powder or dust, or foreign substance are adhered on the surface 2*f* of the feeding roll 2A. Hereinafter, the dirt such as paper powder or dust, or the foreign substance are referred to as "adhered substance 300". Therefore, the adhered substance 300 are not transferred to the wiping surface 2*e* of the web 2 at the time of the wiping operation.

Conversely, as illustrated in FIG. 8B, if the web 2 is rolled so that the wiping surface 2*e* of the web 2 and the surface 2*g* of the winding roll 2B become the same surface, the nozzle surface 411*a* is wiped with the wiping surface 2*e* of the web 2 on which the adhered substance 300 is adhered. Thus, the adhered substance 300 may transfer to the wiping surface 2*e* or may be pushed inside the nozzle on the nozzle surface 411*a* so that discharge failure occurs.

Next, as illustrated in FIG. 9A, the web 2 is rolled so that the wiping surface 2*e* of the web 2 and the surface 2*g* of the winding roll 2B become different surfaces.

Thus, the web 2 is wound on the winding roll 2B so that the waste liquid 301 transferred to the web 2 by the wiping operation of the nozzle surface 411*a* of the head 411 is wound on the winding roll 2B. Thus, the waste liquid 301 is not exposed on the surface 2*g* of the winding roll 2B.

Conversely, as illustrated in FIG. 9B, if the web 2 is rolled so that the wiping surface 2*e* of the web 2 and the surface 2*g* of the winding roll 2B become the same surface, the web 2 is wound on the winding roll 2B so that the waste liquid 301 is exposed on the surface 2*g* of the winding roll 2B. Therefore, the user may easily contact the wiping cartridge 100 and get dirt when the user exchange the wiping cartridge 100 (wiping device 1).

Figure 10A:
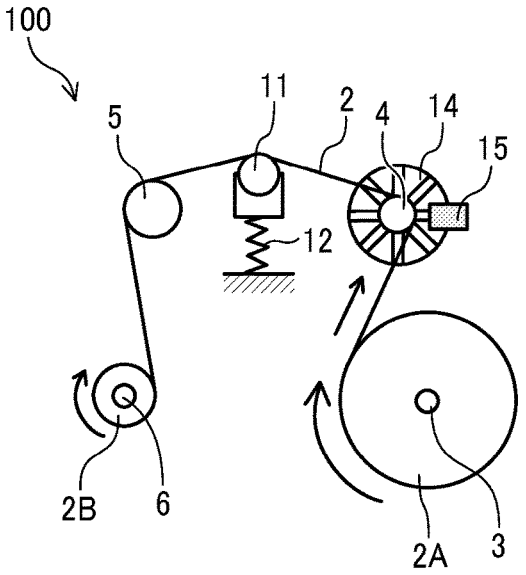
FIGS. 10A to 10C are schematic side views of the wiping cartridge illustrating a formation of slack of the web in the wiping cartridge.
Figure 10B:
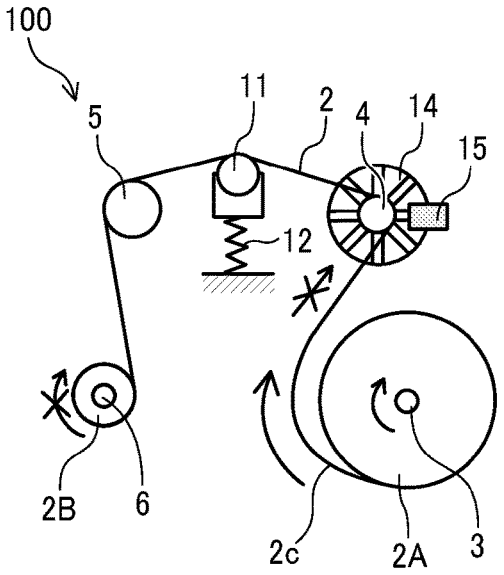
Figure 10C:
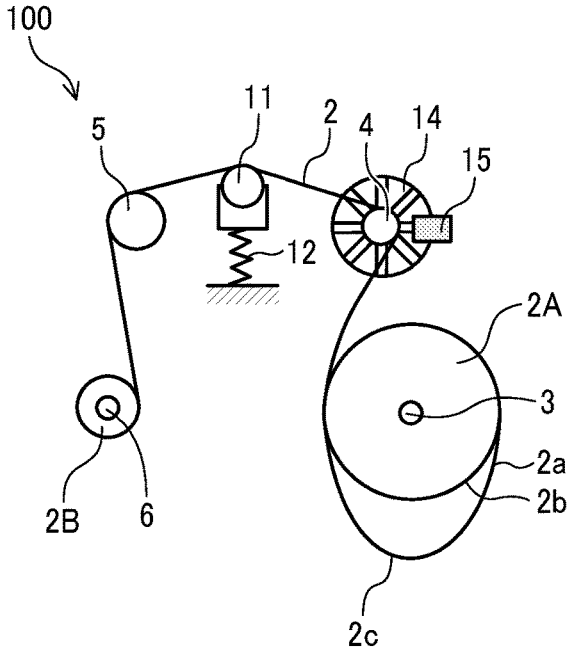
Figure 11A:
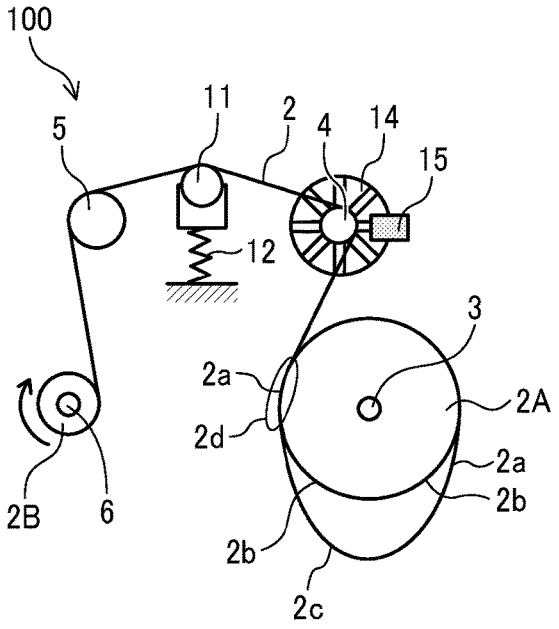
FIGS. 11A and 11B are schematic side views of the wiping cartridge during a winding operation.
Figure 11B:
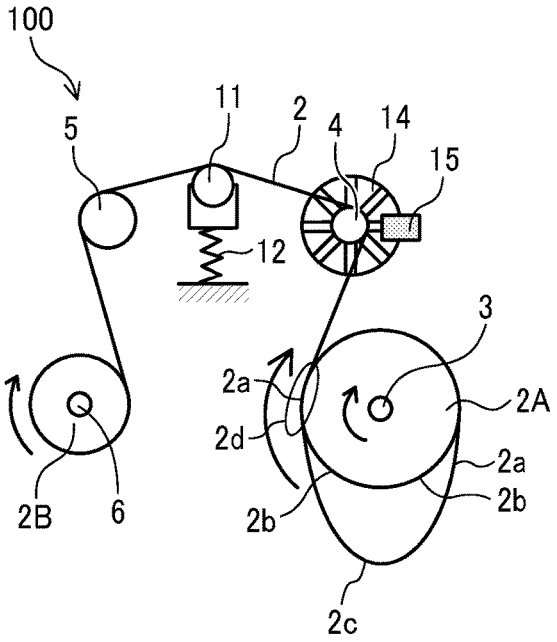

FIGS. 10A to 10C, and FIGS. 11A and 11B illustrate schematic side views of the wiping cartridge 100 during occurrence of slack of the web 2 and the winding operation of the wiping cartridge 100. FIGS. 10A to 10C are schematic side views of the wiping cartridge 100 when slack of the web 2 occurs. FIGS. 11A and 11B are schematic side views of the wiping cartridge 100 during the winding operation. In FIGS. 10A to 10C and 11A and 11B, the wiping cartridge 100 does not include the guide rollers 8 and 9 (see FIG. 7) in the above-described embodiments and includes a conveyance roller 4 as a member to which the web 2 fed from the feeding roll 2A first contacts. Thus, the guide roller 8 in FIG. 7 corresponds to the conveyance roller 4 in FIGS. 10A to 10C and FIGS. 11A and 11B in the present disclosure.

A configuration in which the web 2 is wound from the feeding roll 2A to the winding roll 2B has a problem in which a winding diameter of the winding roll 2B increases with a progress of the winding process. Thus, the winding torque of the web 2 increases. Therefore, the wiping cartridge 100 rotatably holds the feeding roll 2A to prevent an increase in the winding torque that changes according to a winding amount of the web 2 on the feeding roll 2A.

The winding roll 2B is driven to rotate to wind the web 2 by a predetermined amount as illustrated in FIG. 10A, and the winding roll 2B is then stopped driven to rotate as illustrated in FIG. 10B in a configuration in which the feeding roll 2A is rotatably supported. At time of rotation stop of the winding roll 2B, the feeding roll 2A cannot follow the rotation stop of the winding roll 2B because the feeding roll 2A can freely rotate. Thus, the feeding roll 2A rotates an extra amount, and the web 2 may thus be excessively fed from the feeding roll 2A.

As described above, the wiping cartridge 100 freely rotatably supports the feeding roll 2A so that the feeding roll 2A and winding roll 2B cannot be simultaneously stopped. Thus, a slack portion 2*c* of the web 2 is formed on the feeding roll 2A side as illustrated in FIG. 10C.

When the slack portion 2*c* is formed in the web 2, an overlapping portion 2*d* is formed as illustrated in FIG. 11A. The outermost winding portion 2*a* and the inner winding portion 2*b* of the web 2 overlap in the overlapping portion 2*d*. The friction force between the webs 2 in the overlapping portion 2*d* of the webs 2 cause the web 2 and the feeding roll 2A to rotate when the web 2 is wound as illustrated in FIG. 11B Therefore, it is difficult to wind only the slack portion 2*c* of the web 2, and the slack portion 2*c* cannot be eliminated. As described above, the slack portion 2*c* gradually increases with an extra rotation of the feeding roll 2A while the winding operation of the winding roll 2B is stopped.

The slack portion 2*c* of the web 2 becomes large and contacts other portions to let the unwiped web 2 to be attached with dirt or ink. With adhering of the dirt on the unwiped (unused) web 2, instead of wiping the nozzle surface 411*a* with a clean web 2, the nozzle surface 411*a* is wiped by the web 2 on which the dirt is adhered.

As a result, the nozzle surface 411*a* that is a surface to be wiped becomes less clean. Further, the foreign substance (such as dried ink) adhered on the web 2 is pressed against the nozzle surface 411*a* by the wiping operation. Thus, the foreign substance on the web 2 may damage the nozzle surface 411*a*. Further, the foreign substance or dirt may be pushed into the nozzle to cause discharge failure. Further, the slacked web 2 may be entangled to hinder a normal winding operation of the web 2.

FIGS. 12A to 12D, FIGS. 13A to 13D, and FIGS. 14A to 14D illustrate a change of the slack of the web 2 due to a relative position between a guide roller and a feeding roll. FIGS. 12A to 12D, FIGS. 13A to 13D, and FIGS. 14A to 14D illustrate a different relative position between a guide roller and a feeding roll and a state of the slack portion 2*c* of the web 2. In FIGS. 12A to 12D, FIGS. 13A to 13D, and FIGS. 14A to 14D, only the guide roller 8 as a member to which the web 2 fed from the feeding roll 2A first contacts is illustrated.

Whether the slack portion 2*c* can be wound and reduced is determined according to a next wiping operation when the slack portion 2*c* is formed in the web 2 due to a relative position between the feeding roll 2A and the member (guide roller 8) to which the web 2 fed from the feeding roll 2A first contacts.

That is, the slack portion 2*c* of the web 2 hangs vertically downward by gravity. Here, there are conditions of no wind, no operation of the wiping cartridge 100, and no contact with other members.

In a first example illustrated in FIGS. 12A to 12D, the guide roller 8 is disposed opposite to a feeding side (right-side in FIGS. 12A to 12D) of the axis "O" of the feeding roll 2A. In other words, the guide roller 8 is disposed right-side of the axis O of the feeding roll 2A in FIGS. 12A to 12D.

A feed position P at which the winding portion 2*a* of the web 2 is fed from the feeding roll 2A is disposed above the axis O of feeding roll 2A in the arrangement in the first example. A tangent line 8A is drawn vertically on a feeding side (right-side) of the guide roller 8 as illustrated in FIGS. 12A to 12C.

Figure 12A:
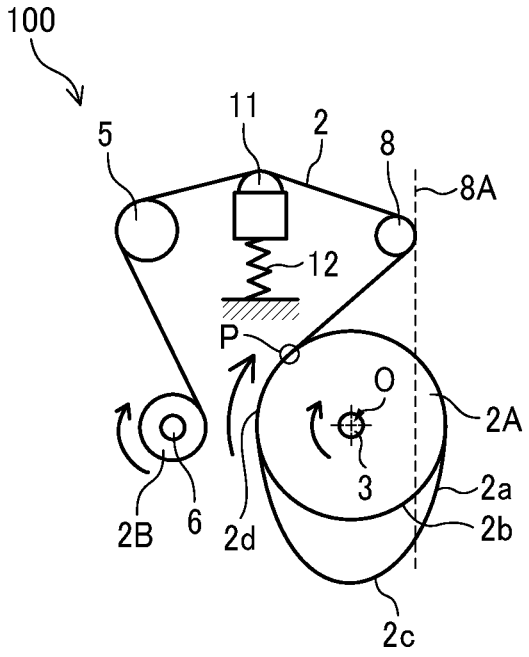
FIGS. 12A to 12D are schematic side views of the wiping cartridge illustrating a slack portion of the web in an arrangement in a first example between a guide roller and a feeding roll.

Thus, the overlapping portion 2*d* between the outermost winding portion 2*a* and the inner winding portion 2*b* is formed at an initial stage of start using the web 2 as illustrated in FIG. 12A. The overlapping portion 2*d* is formed between the outermost winding portion 2*a* and the inner winding portion 2*b*. The outermost winding portion 2*a* is fed at an upstream side (a direction opposite to a direction of rotation of the web 2) of the feed position P of the feeding roll 2A in a feeding direction of the web 2 as indicated by arrow in FIG. 12A. In FIGS. 12A to 12D, the axis O of the feeding roll 2A is disposed between the overlapping portion 2*d* and the tangent line 8A in a horizontal direction.

Figure 12B:
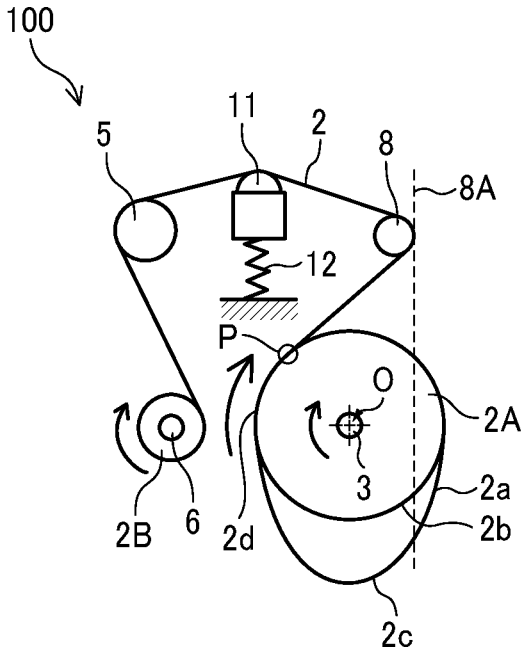

Thus, as illustrated in FIG. 12B, it is difficult to wind only the slack portion 2*c* by winding the web 2 because friction occurred between the webs 2 at the overlapping portion 2*d* of the web 2 when the web 2 is fed in the next winding operation. Thus, the feeding roll 2A itself is rotated, and the slack of the web 2 cannot be reduced, and the slack gradually increases.

Figure 12C:
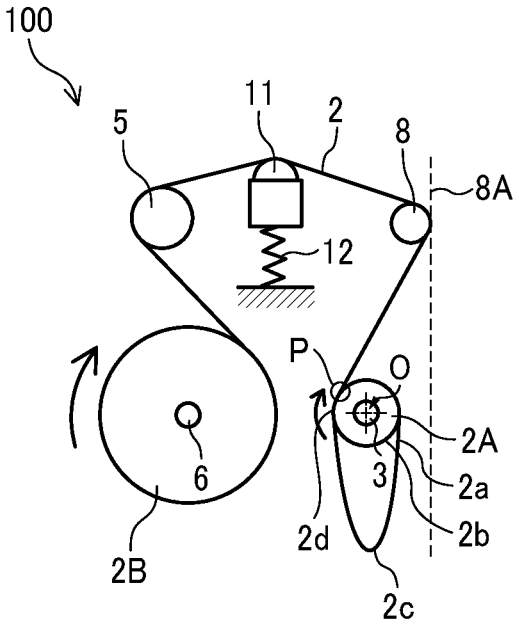
Figure 12D:
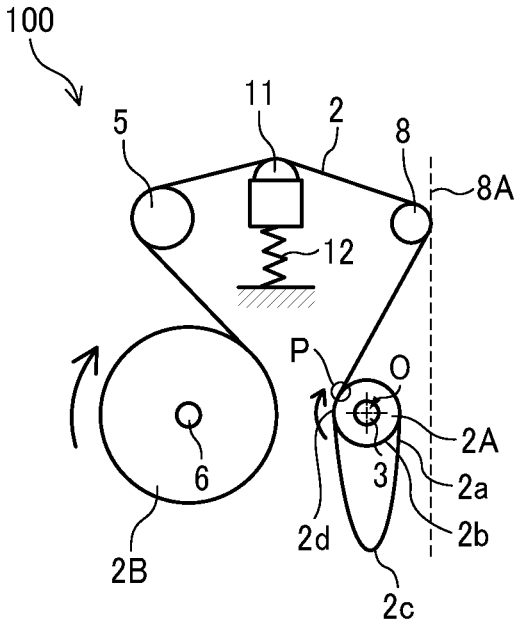

Similarly, as illustrated in FIG. 12C, even a roll diameter of the feeding roll 2A decreases in a vicinity of an end of roll, the slack portion 2*c* and the overlapping portion 2*d* still exists. Therefore, as illustrated in FIG. 12D, even if the web 2 is fed in the next winding operation, it is difficult to wind only the slack portion 2*c* of the web 2.

Next, in the second example illustrated in FIGS. 13A to 13D, the guide roller 8 is disposed so that the web 2 comes into contact with the guide roller 8 at a position vertically above the axial center "O" of the feeding roll 2A.

Figure 13A:
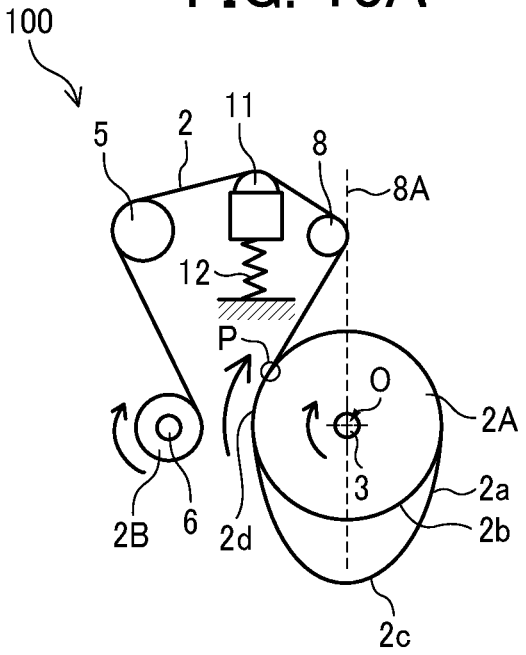
FIGS. 13A to 13D are schematic side views of the wiping cartridge illustrating a slack portion of the web in an arrangement in a second example between a guide roller and a feeding roll.

Also in the arrangement in the second example, the feed position P is disposed above the axis O of the feeding roll 2A in the vertical direction. The feed position P is a position at which the web 2 is fed from the feeding roll 2A. When a tangent line 8A is drawn on a feeding side (right-side in FIG. 12A) of the guide roller 8 along the vertical direction, the tangent line 8A passes through the axis O of the feeding roll 2A as illustrated in FIGS. 13A to 13D Thus, the overlapping portion 2*d* between the outermost winding portion 2*a* and the inner winding portion 2*b* is formed at an initial stage of start using the web 2 as illustrated in FIG. 13A. The overlapping portion 2*d* is formed between the outermost winding portion 2*a* and the inner winding portion 2*b*. The outermost winding portion 2*a* is fed at an upstream side (a direction opposite to a direction of rotation of the feeding roll 2A) of the feed position P of the feeding roll 2A in a feeding direction of the web 2 as indicated by arrow in FIG. 13A.

Figure 13B:
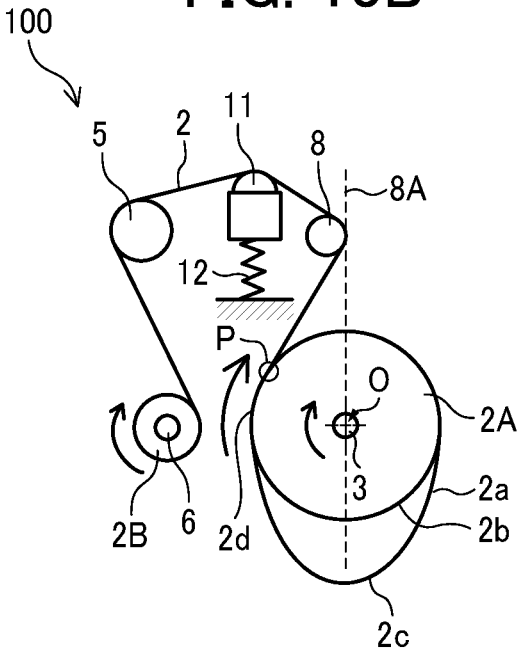

Therefore, as illustrated in FIG. 13B, when the web 2 is to be fed in the next winding operation, it is difficult to wind only the slack portion 2*c* of the web 2 by winding the web 2 owing to a friction occurred between the overlapping portion 2*d* of the web 2. Thus, the feeding roll 2A itself is rotated, and the slack of the web 2 cannot be reduced, and the slack gradually increases.

Figure 13C:
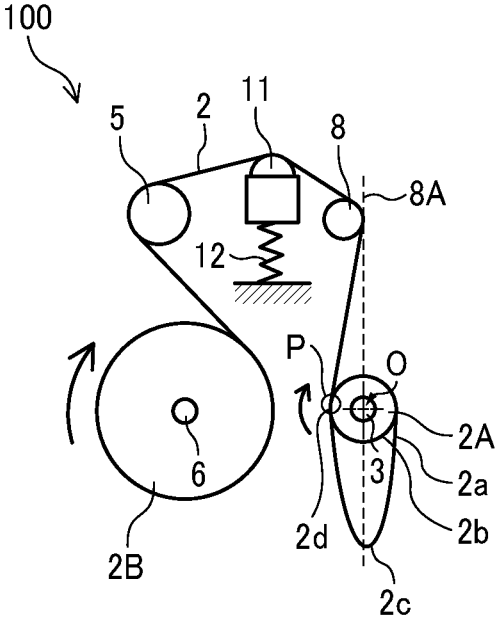
Figure 13D:
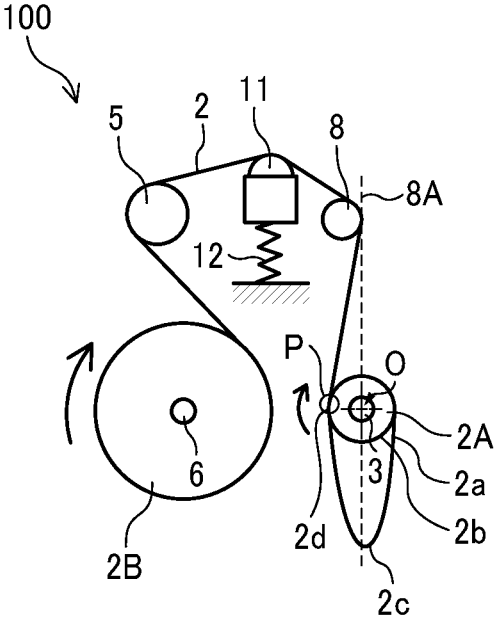

Similarly, as illustrated in FIG. 13C, the overlapping portion 2*d* still exists even when the web 2 is nearly end (used up) and a roll diameter of the feeding roll 2A becomes small. Therefore, as illustrated in FIG. 13D, even if the web 2 is fed in the next winding operation, it is difficult to wind only the slack portion 2*c* of the web 2.

Next, in the third example illustrated in FIGS. 14A to 14D, the guide roller 8 is disposed on the feeding side (left-side in FIG. 14A) of the web 2 of the feeding roll 2A. Specifically, the guide roller 8 is disposed on the feeding side (left-side) of the axis O of the feeding roll 2A. A position of the web 2 contacting the guide roller 8 (see the tangent line 8A indicated by broken line in FIG. 14B) is separated from the feed position P (see FIG. 14B) in a direction opposite to the axis O of the feeding roll 2A in a horizontal direction. The web 2 is fed from the feeding roll 2A at the feed position P.

In the arrangement in the third example, the feed position P (see FIG. 14B) is disposed below the axis O of the feeding roll 2A in the vertical direction. The feed position P is a position at which the web 2 is fed from the feeding roll 2A. When a tangent line 8A is drawn on a feeding side (right-side in FIG. 14A) of the guide roller 8 along the vertical direction, the tangent line 8A is disposed separated from and left-side of the axis O of the feeding roll 2A as illustrated in FIGS. 14A to 14D. In other words, the feed position P is disposed between the tangent line 8A of the guide roller 8 and the axis O of the feeding roll 2A in the horizontal direction.

Figure 14A:
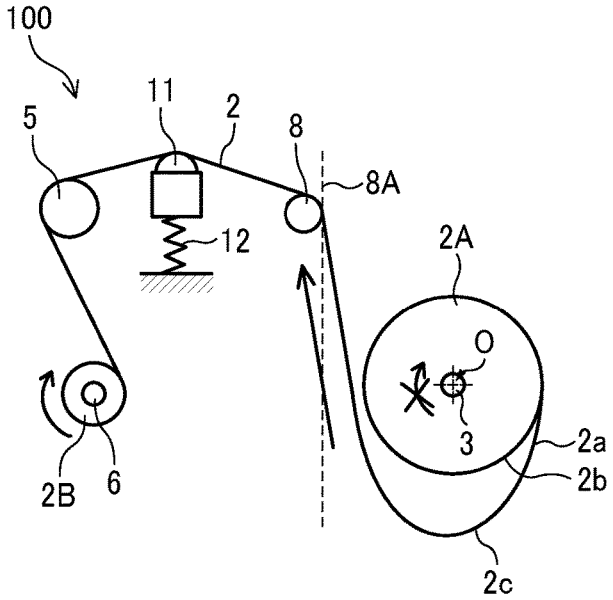
FIGS. 14A to 14D are schematic side views of the wiping cartridge illustrating a slack portion of the web in an arrangement in a third example between a guide roller and a feeding roll.

Therefore, as illustrated in FIG. 14A, at the initial stage of start using the web 2, the slack portion 2*c* of the web 2 of the feeding roll 2A does not overlap the web 2 wound around the feeding roll 2A.

Figure 14B:
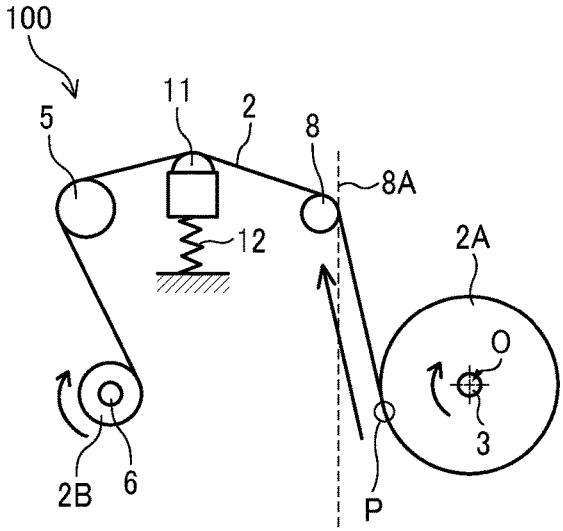

As a result, as illustrated in FIG. 14B, when the web 2 is fed in the next winding operation, only the slack portion 2*c* of the web 2 can be wound up without rotating the axis O of the feeding roll 2A together with the rotation of the guide roller 8. Thus, the wiping cartridge 100 in the third example can reduce the slack portion 2*c*.

Figure 14C:
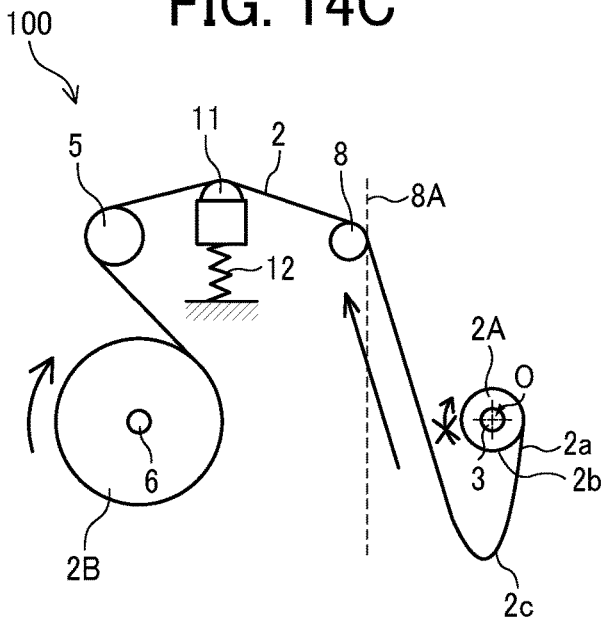
Figure 14D:
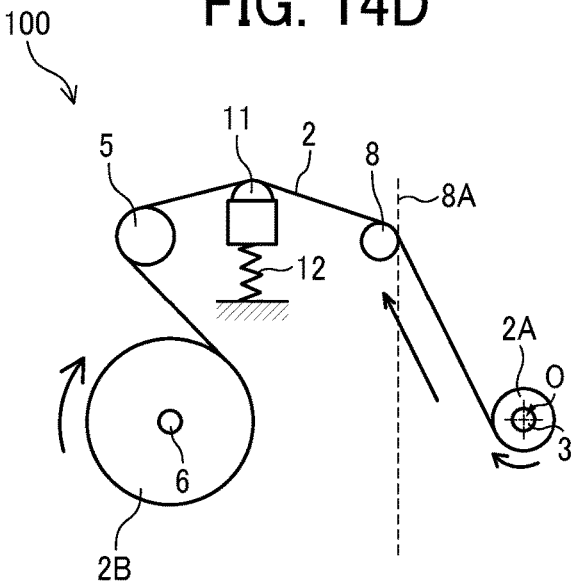

Similarly, as illustrated in FIG. 14C, even when the web 2 is nearly end (used up) and the roll diameter of the feeding roll 2A decreases, the overlapping portion 2*d* is not formed. Thus, as illustrated in FIG. 14D, when the web 2 is fed in the next winding operation, only the slack portion 2*c* of the web 2 can be wound without rotating the feeding roll 2A together with a rotation of the guide roller 8. Thus, the wiping cartridge 100 in the third example can reduce the slack portion 2*c*.

FIGS. 15A to 15C and 16A to 16C illustrate a change in the slack of the web 2 according to a relative position between the guide roller 8 and the feeding roll 3A. FIGS. 15A to 15C and 16A to 16C are side views of the wiping cartridge 100 illustrating different relative position of a guide roller 8 and a feeding roll 2A and a winding operation of the wiping cartridge 100. In FIGS. 15A to 15C and 16A to 16C, only the guide roller 8 is illustrated as a member to which the web 2 fed out from the feeding roll 2A first contacts.

Figure 15A:
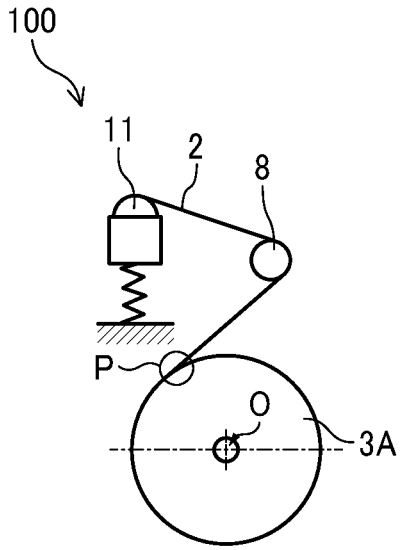
FIGS. 15A to 15C are schematic side views of the wiping cartridge illustrating a slack portion of the web and a winding operation in the arrangement in the first example between a guide roller and a feeding roll.
Figure 15B:
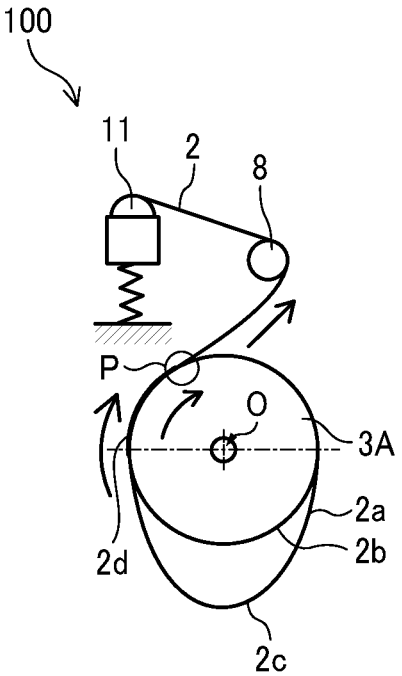
Figure 15C:
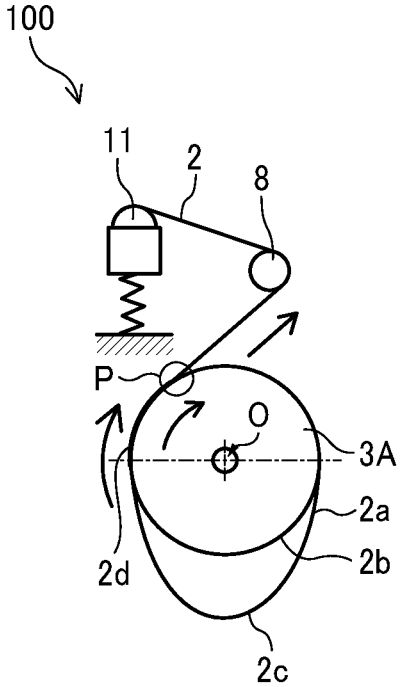

FIGS. 15A to 15C are side views of the wiping cartridge 100 in an arrangement of the first example as described above. As illustrated in FIG. 15A, the feed position P of the web 2 from the feeding roll 2A is disposed above the axis O of the feeding roll 2A. The overlapping portion 2*d* is formed on the feeding roll 2A as illustrated in FIG. 15B. The outermost winding portion 2*a* and the inner winding portion 2*b* overlap in the overlapping portion 2*d*. Thus, even when the slack portion 2*c* of the web 2 is formed in the feeding roll 2A, the overlapping portion 2*d* is also formed in the feeding roll 2A.

Therefore, even the winding operation is performed as illustrated in FIG. 15C, it is difficult to wind only the slack portion 2*c* of the web 2 because the feeding roll 2A itself is rotated by the friction of the overlapping portion 2*d*. Thus, the slack portion 2*c* is not reduced and still exists in the embodiment illustrated in FIG. 15C.

Figure 16A:
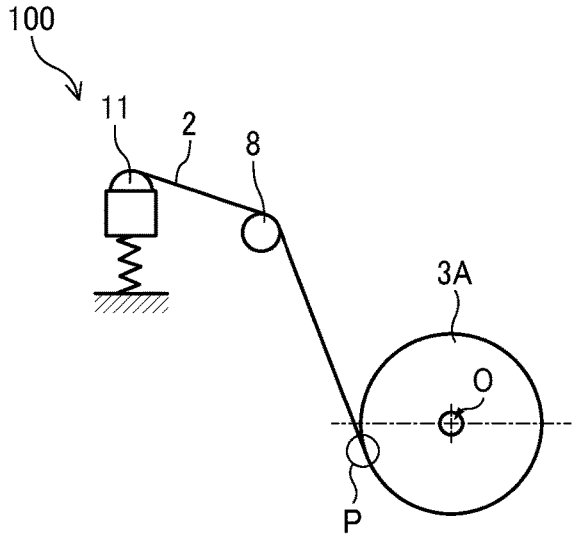
FIGS. 16A to 16C are schematic side views of the wiping cartridge illustrating a slack portion of the web and a winding operation in the arrangement in the third example between a guide roller and a feeding roll.
Figure 16B:
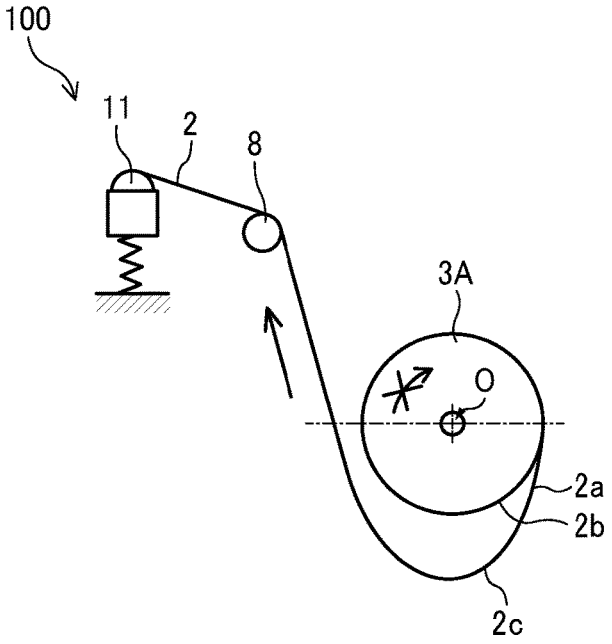
Figure 16C:
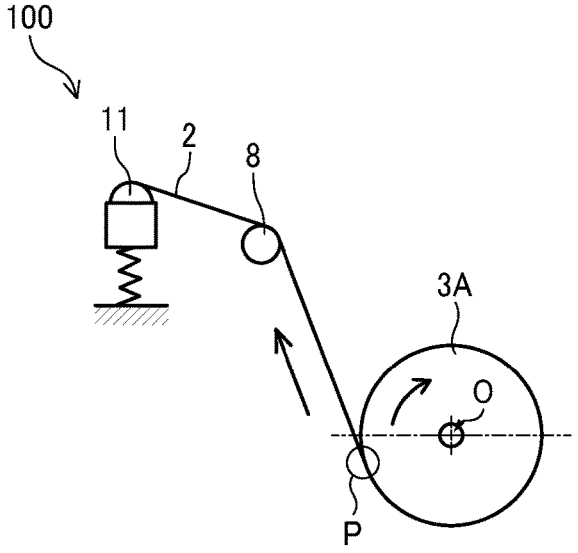

FIGS. 16A to 16C are side views of the wiping cartridge 100 in an arrangement of the third example as described above. As illustrated in FIG. 16A, the feed position P of the web 2 from the feeding roll 2A is disposed below the axis O of the feeding roll 2A. The overlapping portion 2*d* is not formed on the feeding roll 2A as illustrated in FIG. 16B. In FIG. 16B, the outermost winding portion 2*a* and the inner winding portion 2*b* does not overlap to form the overlapping portion 2*d*. Thus, even when the slack portion 2*c* of the web 2 is formed in the feeding roll 2A, the slack portion 2*c* is separated from an outer periphery of the feeding roll 2A and hangs down below a bottom of the inner winding portion 2*b* of the feeding roll 2A.

Therefore, as illustrated in FIG. 16C, feeding the web 2 in the winding operation can wind only the slack portion 2*c* of the web 2 without rotation of the axis O of the feeding roll 2A to reduce the slack portion 2*c*.

Figure 17:
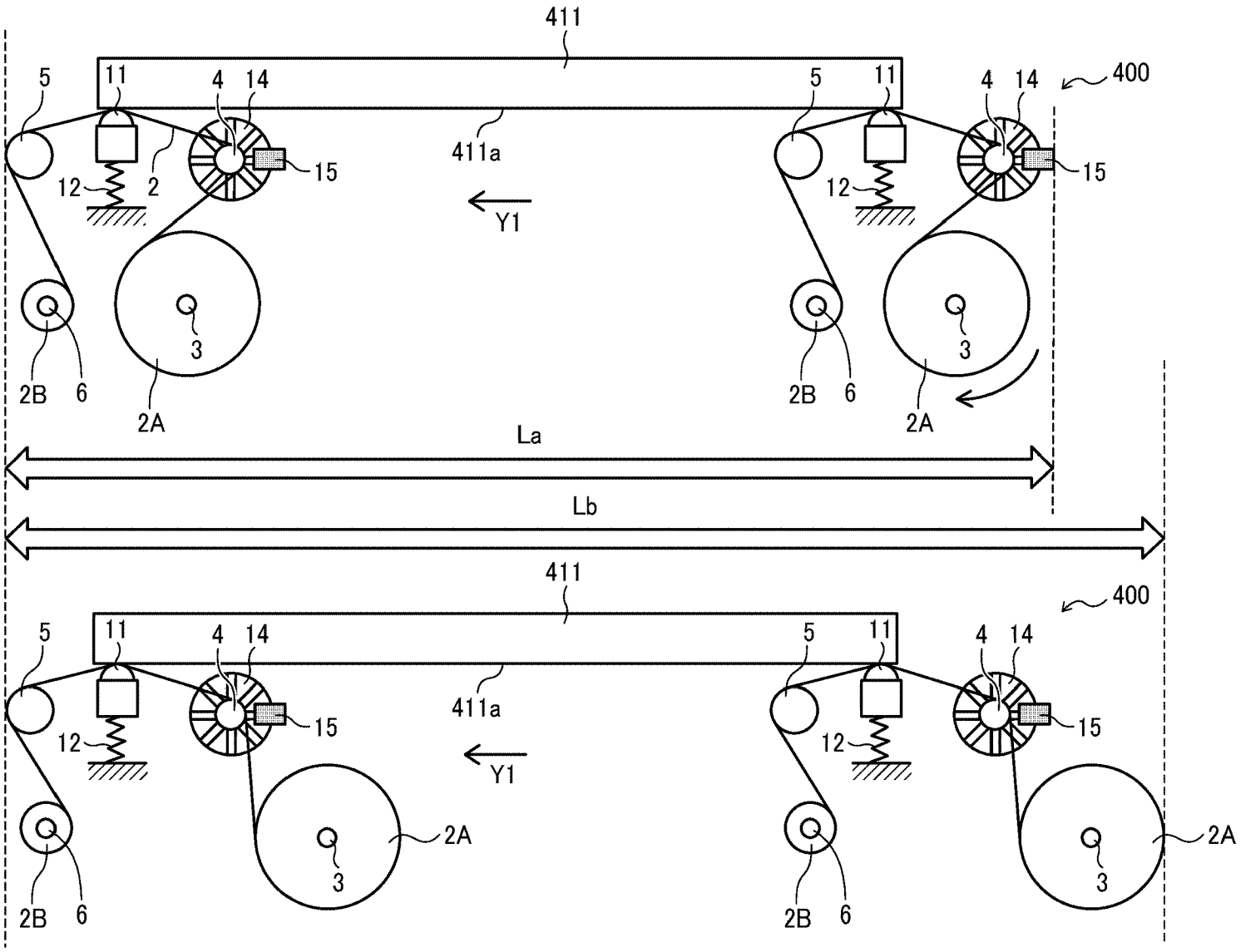
FIG. 17 is an illustration including side views of a liquid discharge apparatus illustrating a necessary movable space of the wiping device in the arrangements of the first example and the third example between the guide roller and the feeding roll.

Parts (a) and (b) of FIG. 17 illustrate a necessary movable space of the wiping device 1 in the first and third examples. Parts (a) and (b) of FIG. 17 are schematic side views of a necessary movable space. The liquid discharge apparatus 400 in FIG. 17 includes the conveyance roller 4 as a member to first contact with the web 2 fed from the feeding roll 2A and does not include the guide rollers 8 and 9 in the above-described embodiments. Thus, the conveyance roller 4 in FIG. 17 serves as the guide rollers 8 and 9 in the above-described embodiments. As illustrated in FIG. 7, the code wheel 14 is attached to the conveyance roller 4.

The arrangement in the first example (see FIGS. 12A to 12D) as illustrated in part (a) of FIG. 17 can reduce a distance between the pressing member 11 and the axis O of the feeding roll 2A in a wiping direction indicated by arrow "Y1" in part (a) of FIG. 17 because the conveyance roller 4 is approximately disposed directly above the feeding roll 2A in the vertical direction.

The web 2 of the wiping cartridge 100 wipes the nozzle surface 411*a* of the head 411 from one end to another end of the nozzle surface 411*a* of the head 411. Thus, a minimum necessary movable space in the arrangement in the first example becomes a distance "La" in part (a) of FIG. 17.

Conversely, in the arrangement in the third example (see FIGS. 14A to 14D) as illustrated in part (b) of FIG. 17, it is necessary to arrange a position at which the web 2 fed from the feeding roll 2A first contact with the conveyance roller 4 to be separated from the outer peripheral surface of the feeding roll 2A in the wiping direction Y1.

Therefore, the feeding roll 2A, the conveyance roller 4, and the pressing member 11 are arranged in series in the above-described order in the wiping direction Y1. Thus, the distance between the pressing member 11 and the axis O of the feeding roll 2A in the third example becomes longer than the arrangement in the first example.

The web 2 of the wiping cartridge 100 wipes the nozzle surface 411*a* of the head 411 from one end to another end of the nozzle surface 411*a* of the head 411. The minimum necessary movable space in the arrangement in the third example becomes a distance Lb larger than the distance (Lb>La), and a size of the liquid discharge apparatus 400 increases.

Although the slack portion 2*c* of the web 2 may not be reduced in an arrangement in the first example (the same as the second example), the first example can reduce the size of the liquid discharge apparatus 400. Conversely, the arrangement configuration in the third example can reduce the slack portion 2*c* of the web 2 although the third example increases the size of the liquid discharge apparatus 400.

Figure 18A:
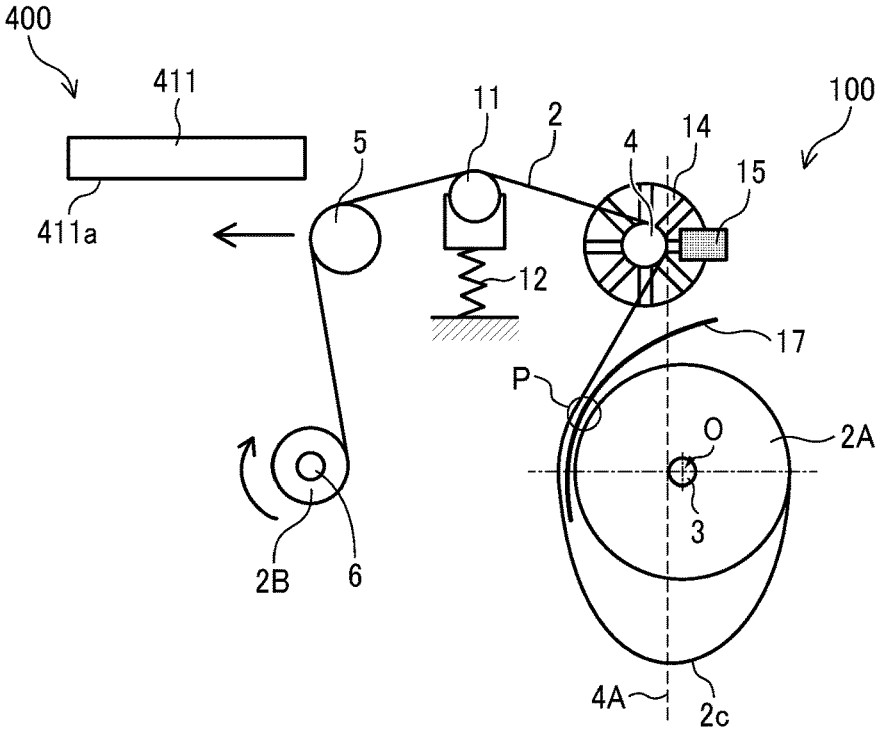
FIGS. 18A and 18B are side views of the liquid discharge apparatus illustrating a winding operation of the wiping cartridge according to the first embodiment.
Figure 18B:
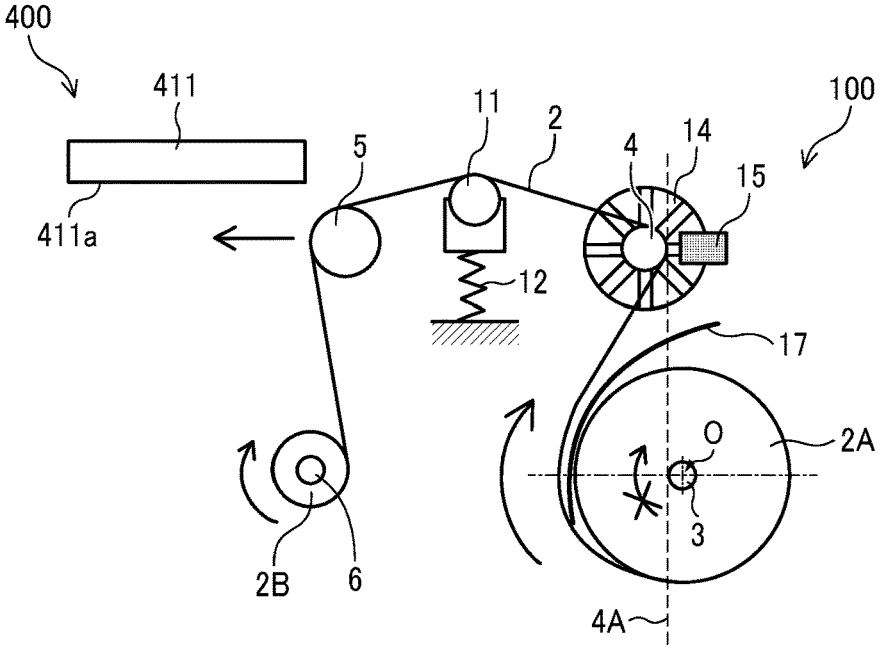

Next, a winding operation of the wiping cartridge according to the third embodiment is described with reference to FIGS. 18A and 18B. In FIGS. 18A and 18B, a tangent line 4A of the conveyance roller 4 is disposed left-side (feeding-side) of the axis O of the feeding roll 2A as in the third example illustrated in FIGS. 14A to 14D. However, the axis O of the feeding roll 2A is arranged closed to the tangent line 8A of the conveyance roller 4. Thus, when the feeding roll 2A has enough length of web 2 around the feeding roller 3, the slack portion 2*c* and the overlapping portion 2*d* may be formed as in the first example as illustrated in FIGS. 12A to 12D. FIGS. 18A and 18B are side views of the wiping cartridge 100 illustrating the winding operation of the wiping cartridge 100. The liquid discharge apparatus 400 in FIGS. 18A and 18B includes the conveyance roller 4 as a member to first contact with the web 2 fed from the feeding roll 2A and does not include the guide rollers 8 and 9 in the above-described embodiments. Thus, the conveyance roller 4 in FIGS. 18A and 18B serves as the guide rollers 8 and 9 in the above-described embodiments. As illustrated in FIG. 7, the code wheel 14 is attached to the conveyance roller 4.

The wiping cartridge 100 according to the present disclosure as illustrated in FIGS. 18A and 18B includes a partition 17 sandwiched between the outermost winding portion 2*a* of the web 2 fed from the feeding roll 2A and the inner winding portion 2*b* overlapped with the outermost winding portion 2*a*.

Thus, even when the overlapping portion 2*d* of the webs 2 is formed as in the arrangement in the first example (see FIGS. 12A to 12D), the web 2 fed from the feeding roll 2A contacts the partition 17 as illustrated in FIG. 18A. Thus, the partition 17 reduce the friction force occurred between the web 2 fed from the feeding roll 2A and the feeding roll 2A. Thus, the partition 17 prevents the axis O of the feeding roll 2A to rotate with the winding operation of the web 2.

Therefore, even when the slack portion 2*c* of the web 2 is formed on the feeding roll 2A, the winding operation is performed to feed the slack portion 2*c* first to wind only the slack portion 2*c* to reduce the slack portion 2*c* as illustrated in FIG. 18B.

As described above, even if the slack portion 2*c* of the web 2 is formed in the feeding roll 2A due to the winding operation of the web 2, the wiping cartridge 100 according to the present disclosure can perform the next winding operation to wind the slack portion 2*c*. Thus, the wiping cartridge 100 can reduce the slack portion 2*c* of the web 2 in the feeding roll 2A.

Further, the wiping cartridge 100 has the arrangement similar to the first example to enable the pressing member 11 to be disposed close to the feeding roll 2A. The example illustrated in FIGS. 18A and 18B has a configuration of third example (see FIGS. 14A to 14D) although the axis O of the feeding roll 2A is disposed closed to the tangent line 4A to reduce the distance between the pressing member 11 and the feeding toll 2A as in the first example (see FIGS. 12A to 12D). Thus, the wiping cartridge 100 can relatively reduce the necessary movable space and reduce the size of the liquid discharge apparatus 400.

Figure 19:
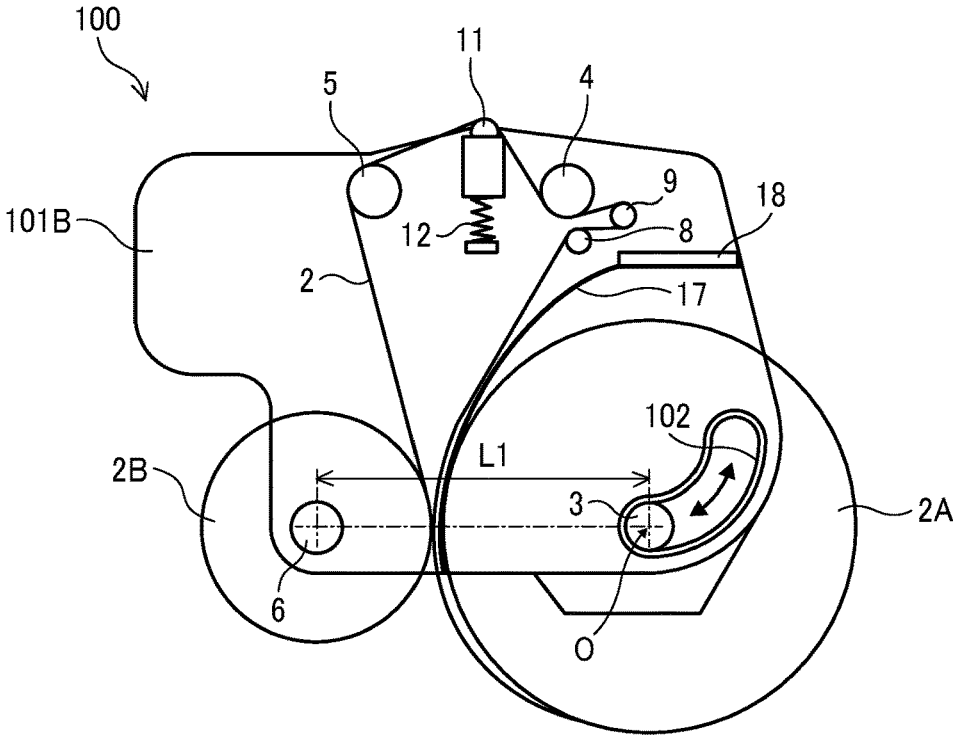
FIG. 19 is a side view of the wiping cartridge illustrating a state of transition of the feeding roll and the winding roll during the wiping operation of the wiping cartridge according to the first embodiment.
Figure 20:
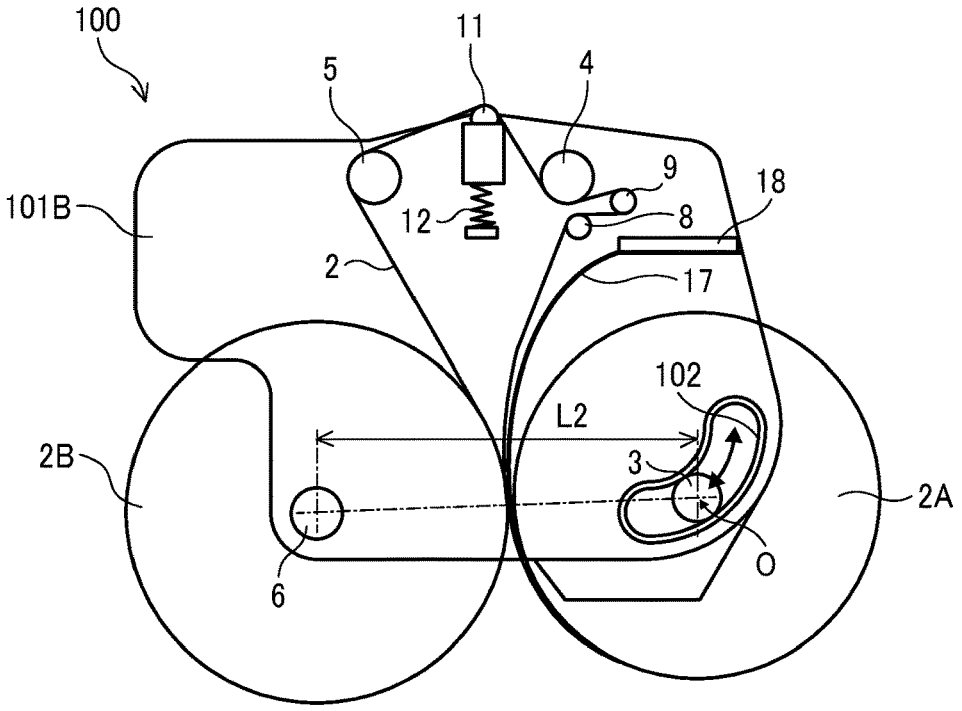
FIG. 20 is a side view of the wiping cartridge illustrating the state of transition after FIG. 19.
Figure 21:
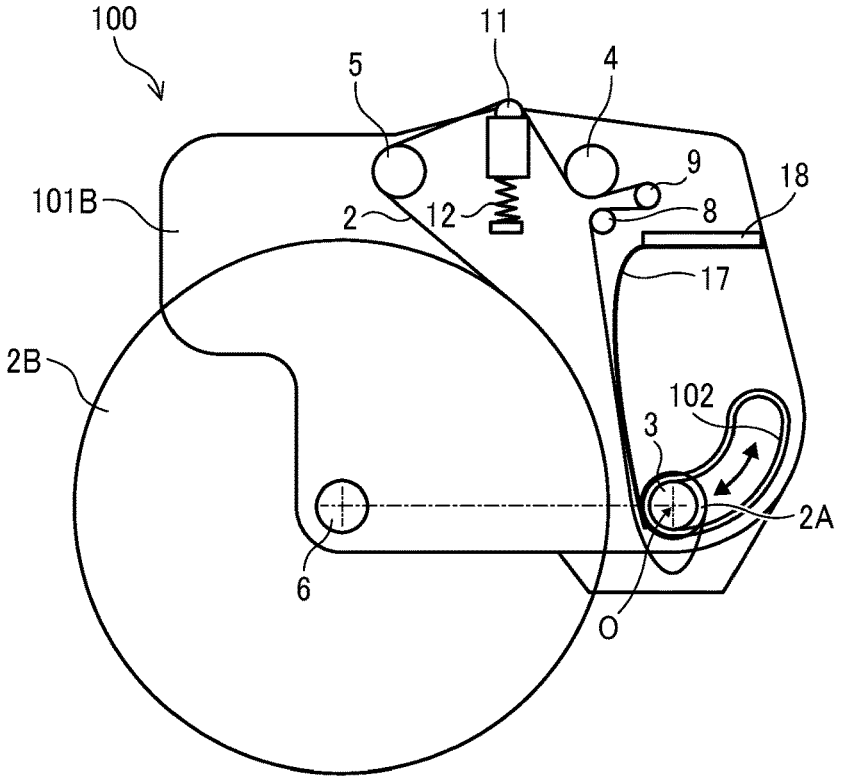
FIG. 21 is a side view of the wiping cartridge illustrating the state of transition after FIG. 20.

Next, a transition state of the feeding roll 2A and the winding roll 2B accompanied with the wiping operation is described with reference to FIGS. 19 to 21. FIGS. 19 to 21 are side views of the wiping cartridge 100 illustrating the winding operation of the wiping cartridge 100.

First, an outer diameter of the feeding roll 2A is larger than an outer diameter of the winding roll 2B in an initial state as illustrated in above-described FIG. 6. That is, the web 2 of the feeding roll 2A is in an unwind state in the initial state. Then, the feeding roller 3 moves to a lower end of a guide groove 102 by an own weight of the feeding roll 2A. Thus, the feeding roller 3 is disposed at a position closest to the winding roller 6 in FIG. 19.

An axial distance between the feeding roller 3 and the winding roller 6 in the initial state becomes the shortest axial distance L1 as illustrated in FIG. 19.

The web 2 is fed from the feeding roll 2A and wound on the winding roll 2B while the wiping operation is repeated from the initial state. The outer diameter of the feeding roll 2A decreases, and the outer diameter of the winding roll 2B increases with the progress of the wiping operation and the winding operation.

Then, the outer periphery of the winding roll 2B contacts the outer periphery of the feeding roll 2A as illustrated in FIG. 19 with a progress of the winding operation of the web 2 from the feeding roll 2A to winding roll 2B, for example. The shortest axial distance L1 is maintained until the above-described condition is satisfied.

Further, the winding roll 2B pushes the feeding roll 2A with an increase of the outer diameter of the winding roll 2B as illustrated in FIG. 20. As a result, the feeding roller 3 moves obliquely upward along the guide groove 102 in a direction indicated by arrow in FIG. 20 while separating (moving away) from the winding roller 6.

Then, the outer diameter of the winding roll 2B becomes substantially same as the diameter of the feeding roll 2A as illustrated in FIG. 20. In FIG. 20, the axial distance L2 between the feeding roller 3 and the winding roller 6 becomes the longest axial distance (L2>L1).

Further, when all the webs 2 are used, the outer diameter of the feeding roll 2A becomes minimum and the outer diameter of the winding roll 2B becomes the maximum as illustrated in FIG. 21.

As described above, the wiping cartridge 100 according to the present disclosure includes the axis O (feeding roller 3) of the feeding roll 2A relatively movable to an axis (winding roller 6) of the winding roll 2B. However, the axis (winding roller 6) of the winding roll 2B may be relatively movable to the axis O (feeding roller 3) of the feeding roll 2A.

If the wiping cartridge 100 has a configuration in which both of the feeding roller 3 and the winding roller 6 do not move relative to each other, the feeding roller 3 and the winding roller 6 have to be fixed to the cartridge case 101 at the longest axial distance L2 so that the feeding roll 2A and the winding roll 2B can have a state as illustrated in FIG. 20.

Thus, if the length of the web 2 increases that increases the maximum outer diameter of the feeding roll 2A, the axial distance between the feeding roller 3 and the winding roller 6 has to be increased accordingly. Thus, the size of the wiping cartridge 100 (roll device) and the wiping device 1 increases. Conversely, it is necessary to reduce the outer diameter of the feeding roll 2A to reduce the size of the wiping cartridge 100 (roll device) and the wiping device 1 (roll apparatus). Thus, an exchange frequency of the web 2 increases.

Conversely, the wiping cartridge 100 according to the present embodiment includes the feeding roller 3 relatively movable to the winding roller 6 so that the axial distance between the feeding roll 2A and the winding roll 2B is variable. Thus, the feeding roller 3 and the winding roller 6 can be arranged at a shorter distance than the longest axial distance L2.

Thus, it is possible to reduce a size of the wiping cartridge 100 (roll device) and the wiping device 1 (roll apparatus) while increasing the diameter and the length of the feeding roll 2A to reduce the exchange frequency of the wiping member (roll).

The wiping cartridge 100 according to the present embodiment includes the feeding roller 3 relatively movable to the winding roller 6 as described above. However, the winding roller 6 may be relatively movable to the feeding roller 3. It is simpler to relatively move the feeding roller 3 rotated with the winding roller 6 since the winding roller 6 is rotationally driven by the winding motor 38 (see FIG. 7).

Figure 22:
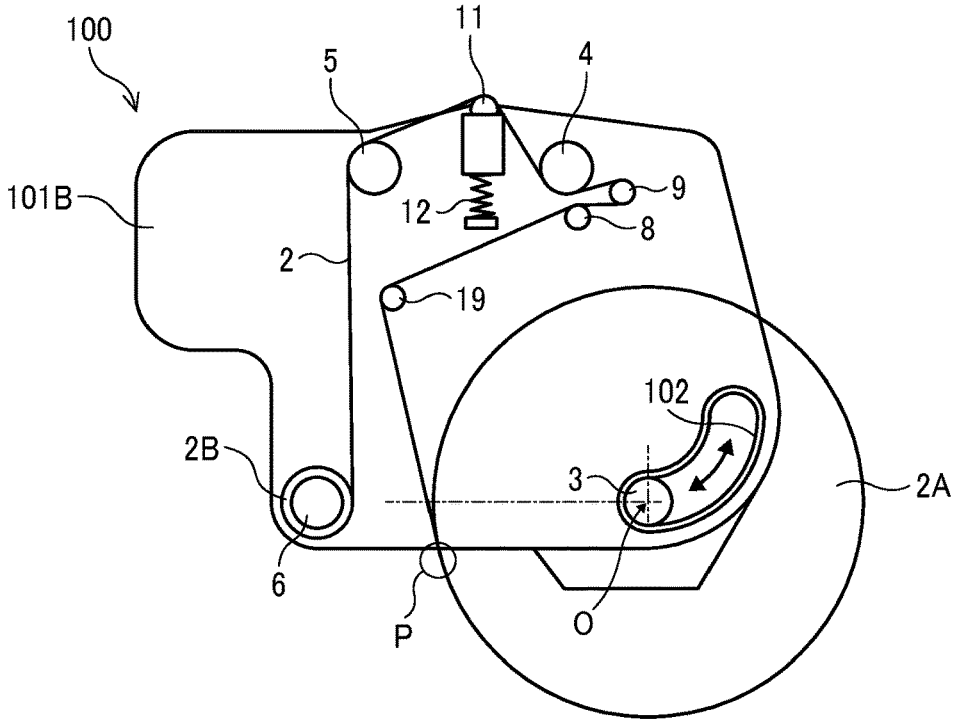
FIG. 22 is a side view of the wiping cartridge as a wiping unit (roll unit) according to a second embodiment of the present disclosure.
Figure 23:
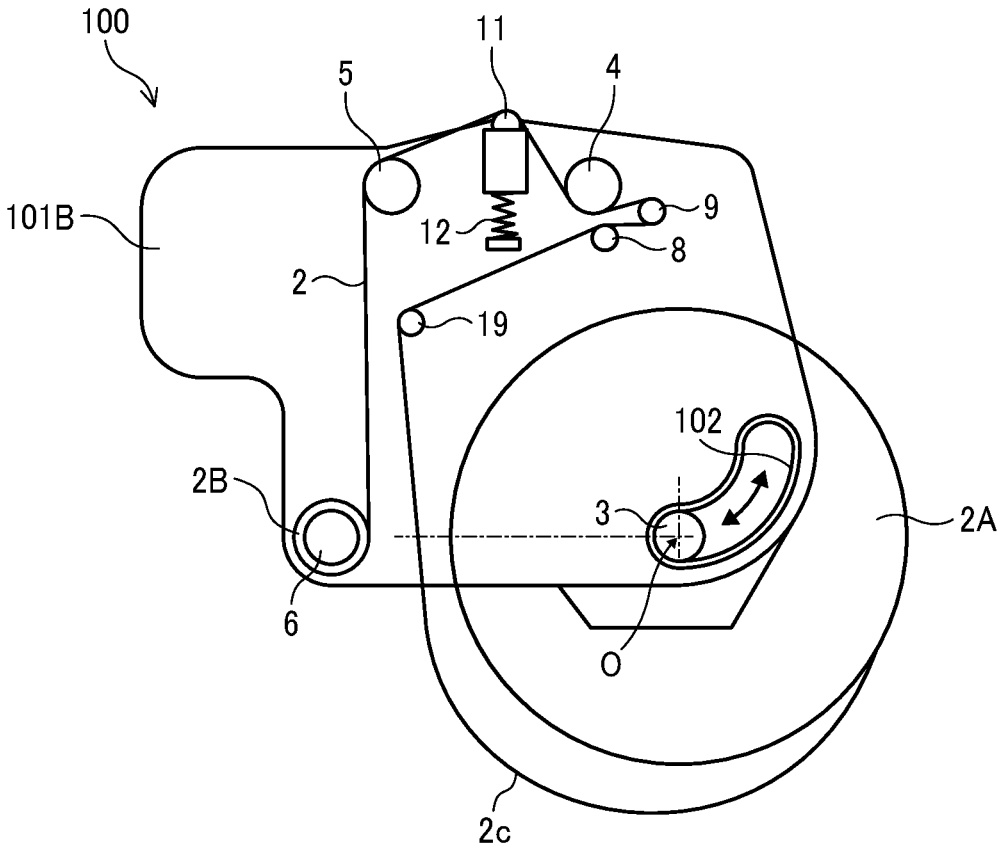
FIG. 23 is a side view of the wiping cartridge in which slack portion of the web is formed.

Next, a second embodiment of the present disclosure is described with reference to FIGS. 22 and 23. FIG. 22 is a side view of the wiping cartridge as a wiping unit (roll unit) according to a second embodiment of the present disclosure. FIG. 23 is a side view of the wiping cartridge 100 in a state in which a slack portion 2*c* of the web 2 is formed according to the second embodiment of the present disclosure.

The wiping cartridge 100 according to the second embodiment includes a roller 19 as a guide to which the web 2 fed from the feeding roll 2A first contacts. The roller 19 is disposed so that the feed position P of the web 2 fed from the feeding roll 2A becomes vertically lower than the axis O of the feeding roll 2A as illustrated in FIG. 23 and FIG. 16A to 16C. The feed position P is a position at which the web 2 separates from the feeding roll 2A.

Thus, the configuration as illustrated in FIG. 23 can prevent a formation of the overlapping portion 2*d* of the web 2 in the feeding roll 2A similarly to the arrangement in the third example as illustrated in FIGS. 16A to 16C. Therefore, as illustrated in FIG. 23, the wiping cartridge 100 can feed only the slack portion 2*c* first without rotating the feeding roll 2A in the next winding operation even when the slack portion 2*c* of the web 2 is formed in the feeding roll 2A. Thus, the wiping cartridge 100 can reduce the slack portion 2*c* in the feeding roll 2A.

The roller 19 (guide) is disposed closer to the winding roll 2B than the feeding roll 2A in the wiping direction Y1 (see FIG. 17) is also disposed below the pressing member 11. Thus, a size of the wiping cartridge 100 in the wiping direction Y1 is greatly reduced.

The guide is not limited to the roller as the roller 19 in FIG. 23. The guide may be a simple plate-like member or a curved member, for example.

Figure 24:
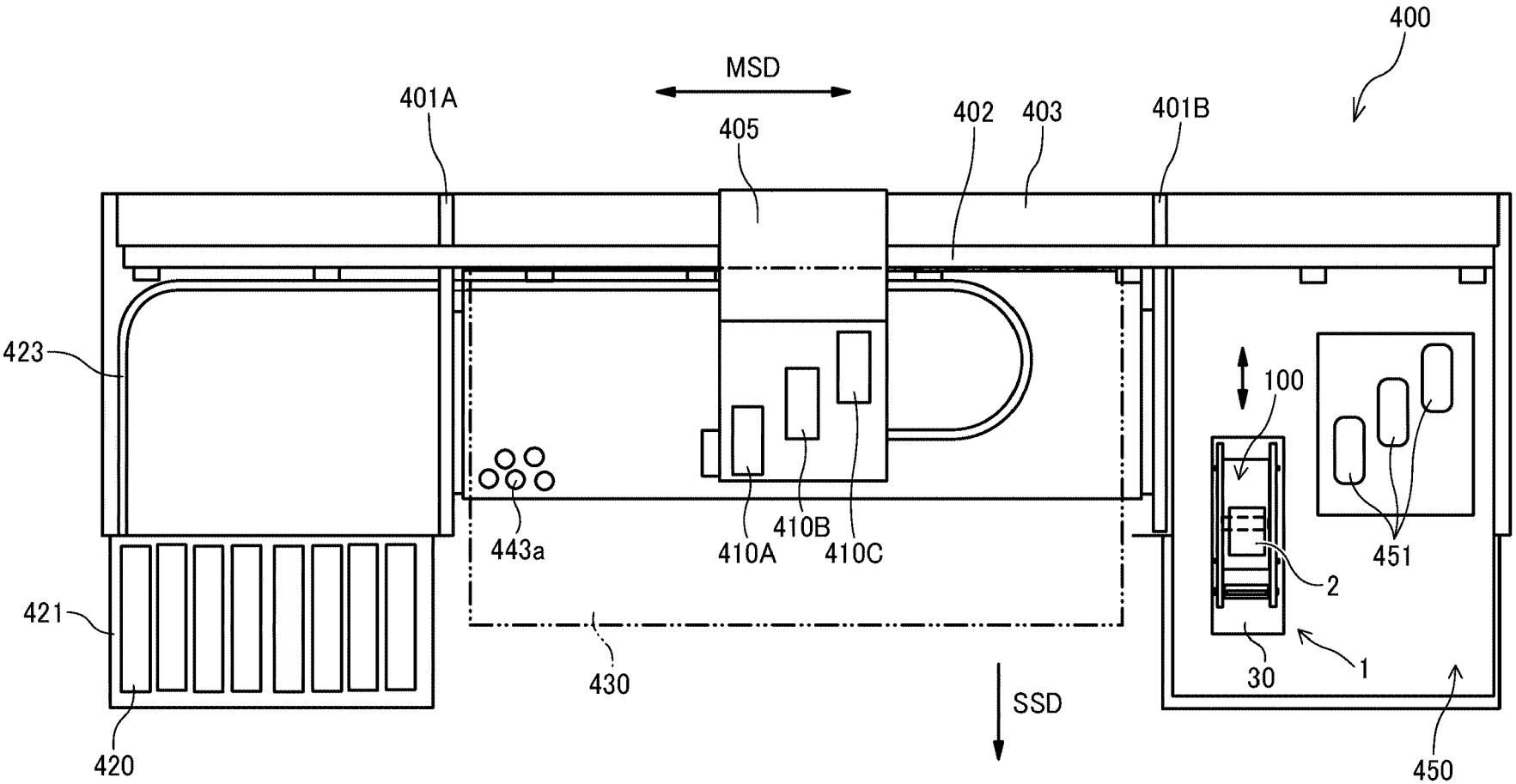
FIG. 24 is a schematic plan view of a mechanical portion of an example of the liquid discharge apparatus according to the present disclosure.
Figure 25:
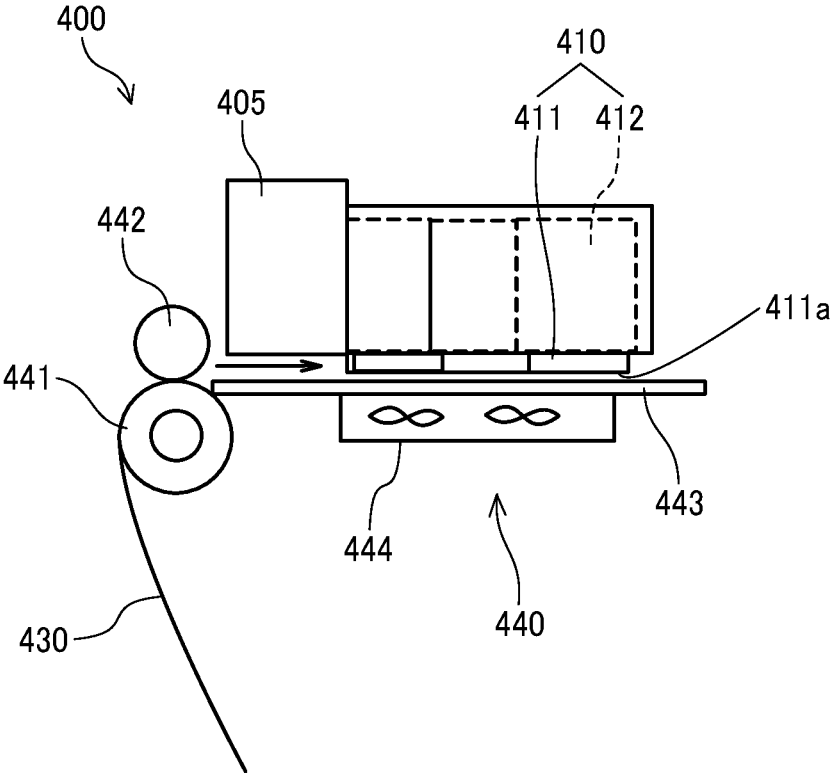
FIG. 25 is a side view of a portion of the liquid discharge apparatus.

Next, an example of the liquid discharge apparatus 400 according to the present disclosure is described with reference to FIGS. 24 and 25. FIG. 24 is a plan view of a portion of the liquid discharge apparatus 400. FIG. 25 is a side view of a portion of the liquid discharge apparatus 400.

The liquid discharge apparatus 400 according to the present disclosure is a serial-type liquid discharge apparatus and includes a guide assembly, such as a main guide 402 laterally bridged between left and right-side plates 401A and 401B and a sub-guide 403, to movably support a carriage 405 in a main scanning direction indicated by arrow MSD in FIG. 24.

Further, three liquid discharge devices 410A to 410C each includes the head 411 are mounted on the carriage 405 as illustrated in FIG. 24. The three liquid discharge devices 410A to 410C are collectively referred to as a "liquid discharge device 410". Each of the liquid discharge devices 410A to 410C includes the head 411 as a liquid discharge means and a sub tank 412 to supply liquid to the head 411.

A cartridge holder 421 is disposed at an apparatus body of the liquid discharge apparatus 400. Main tanks 420 (liquid cartridges) to contain liquid of the respective colors are removably mounted to the cartridge holder 421. The cartridge holder 421 includes a liquid feed pump 422, etc., to supply liquid of the respective colors from the main tanks 420, mounted on the cartridge holder 421 to the heads 411 of the liquid discharge devices 410 via a supply path 423 including supply tubes of respective colors.

Further, the liquid discharge apparatus 400 includes a conveyor 440 to attract a sheet 430 and convey the sheet 430 opposite to the head 411 to convey the sheet 430 in a sub scanning direction indicated by arrow SSD in FIG. 24.

The conveyor 440 includes a conveyance roller 441, a pressure roller 442, a platen 443, and a suction mechanism 444 (see FIG. 25). The pressure roller 442 contacts the conveyance roller 441 and applies a pressure onto the conveyance roller 441. The platen 443 faces the head 411 to guide a sheet 430. The platen 443 includes suction holes 443*a* formed all over an entire surface of the platen 443. In FIG. 24, only a portion of the suction holes 443*a* is illustrated. The suction mechanism 444 attracts the sheet 430 through suction holes 443*a* of the platen 443. Although the suction holes 443*a* are partially illustrated in FIG. 24, the suction holes 443*a* are entirely disposed on the platen 443.

The liquid discharge apparatus 400 includes a maintenance mechanism 450 to maintain and recover a discharge function the head 411. The maintenance mechanism 450 is disposed on one side (right-side in FIG. 24) of the liquid discharge apparatus 400 in the main scanning direction MSD of the carriage 405.

The maintenance mechanism 450 is an example of a head maintenance device according to the present disclosure. The maintenance mechanism 450 includes a cap 451 to cap the nozzle surface 411*a* of the head 411 and a wiping cartridge 100 of the wiping device 1 according to the present disclosure to wipe the nozzle surface 411*a*, for example.

The liquid discharge apparatus 400 conveys the sheet 430 along the platen 443 in a conveyance direction by the conveyance roller 441 and the pressure roller 442 while attracting the sheet 430 onto the platen 443. The conveyance direction of the sheet 430 is also referred to as "sub-scanning direction" indicated by "SSD" in FIG. 24. The sub-scanning direction SSD is perpendicular to the main scanning direction MSD.

The head 411 is driven in response to print signals while the carriage 405 moves in the main scanning direction MSD, to discharge the liquid of a desired color to the sheet 430 stopped, thus printing one line of an image on the sheet 430. Then, the sheet 430 is fed by a predetermined distance to print next line of the image. The above-described operations of feeding and printing are repeated to form a desired image on the sheet 430, and then the sheet 430 is ejected.

The liquid discharge apparatus 400 includes the head maintenance device that includes the wiping device 1 according to the present disclosure as described above. Thus, the liquid discharge apparatus 400 can clean the nozzle surface 20*a* to enable the head 411 to perform stable liquid discharge. Further, the wiping cartridge 100 can reduce the size of the liquid discharge apparatus 400.

In the above embodiments, the wiping cartridge 100 as a roll unit using a wiping member such as the web 2 as the belt-like member, the wiping device 1 as the roll apparatus, the head maintenance device, and the liquid discharge apparatus 400 are described. However, the web 2 (belt-like member) is not limited to a wiping member. For example, the wiping cartridge 100 according to the present disclosure may be applied to a roll unit, a roll apparatus, for example, using a rolled sheet.

In other words, an object to be wound onto the feeding roll 2A and the winding roll 2B is not limited only to the web 2. The present disclosure may be applied the object as long as the object is generally wound in a roll shape (belt-like member) such as paper such as roll paper, label, tape, fabric for clothing, and the like.

Also, the thickness and the material of the web member are not limited. A feeding route (rolling arrangement) of the web 2 and an arrangement of the feeding roll 2A and a winding roll 2B may be appropriately changed according to the application of a roll device and a roll apparatus.

The wiping cartridge 100 according to the present disclosure is particularly effective for a product in which a total weight of the web 2 wound as the feeding roll 2A is small for an easier movement of a roll.

In the present disclosure, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, and a main scan moving unit.

Here, examples of the single unit include a combination in which the head and a functional part(s) are secured to each other through, e.g., fastening, bonding, or engaging, and a combination in which one of the head and a functional part(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. A unit including a filter can be added at a position between the head tank and the head of the liquid discharge device.

In another example, a liquid discharge head and a carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head tank or the channel member mounted on the head so that the head and a supply assembly form a single unit. Liquid is supplied from a liquid reservoir source to the head via the tube.

Examples of the main scan moving unit include a single guide member. The supply assembly may include only a tube(s) or a loading unit.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A roll device comprising:

a feeding roll in which a web is wound;

a winding roll configured to wind the web fed from the feeding roll; and a partition inserted between layers of the web of the feeding roll, wherein the partition is disposed to separate an outermost layer of the web of the feeding roll from an inner layer of the web overlapped with the outermost layer, wherein the web is fed upward from the feeding roll, and a leading end of the partition is disposed lower than an axis of the feeding roll in a vertical direction.

2. The roll device according to claim 1, wherein the partition has a shape of a sheet.

3. The roll device according to claim 1, wherein the leading end of the partition is inserted between the outermost layer and the inner layer of the web in a direction counter to a winding direction in which the winding roll winds the web fed from the feeding roll.

4. The roll device according to claim 1, wherein the partition is flexible.

5. The roll device according to claim 1, wherein a coefficient of static friction between the partition and the web is smaller than a coefficient of static friction between the outermost layer and the inner layer of the web.

6. A roll apparatus comprising the roll device according to claim 1.

7. The roll apparatus according to claim 6, wherein the web is a wiper.

* * * * *